US006291128B1

(12) United States Patent
Meschter et al.

(10) Patent No.: US 6,291,128 B1
(45) Date of Patent: Sep. 18, 2001

(54) PHOTOGRAPHIC FILM ASSEMBLAGES OF THE SELF-DEVELOPING TYPE HAVING REMOVABLE PORTIONS

(75) Inventors: John E. Meschter, Stow; Richard P. Breen, Jr., Gloucester; Philip R. Norris, No. Reading, all of MA (US)

(73) Assignee: Polaroid Corporation, Cambridge, MA (US)

( * ) Notice: Subject to any disclaimer, the term of this patent is extended or adjusted under 35 U.S.C. 154(b) by 0 days.

(21) Appl. No.: 09/672,575

(22) Filed: Sep. 28, 2000

Related U.S. Application Data

(63) Continuation-in-part of application No. 08/959,361, filed on Oct. 28, 1997, now Pat. No. 5,981,137.

(60) Provisional application No. 60/156,984, filed on Oct. 1, 1999, and provisional application No. 60/040,797, filed on Mar. 17, 1997.

(51) Int. Cl.[7] ..... G03C 8/44; G03C 8/46; G03C 8/48

(52) U.S. Cl. ..... 430/208; 430/207; 430/209; 396/283; 396/585

(58) Field of Search ..... 430/207, 208, 430/209, 210; 396/583, 585

(56) References Cited

U.S. PATENT DOCUMENTS

| | | | | |
|---|---|---|---|---|
| 2,609,296 | | 9/1952 | Land | 95/8 |
| 2,634,886 | * | 4/1953 | Land | 430/208 |
| 2,708,864 | | 5/1955 | Land | 95/89 |
| 3,415,645 | | 12/1968 | Land | 96/3 |
| 3,652,282 | | 3/1972 | Land | 96/76 |
| 3,695,884 | | 10/1972 | Land | 96/76 C |
| 3,767,405 | * | 10/1973 | Harvey | 430/207 |
| 3,794,490 | * | 2/1974 | Nerwin | 430/207 |
| 3,804,626 | | 4/1974 | Harvey | 96/76 C |
| 3,832,182 | * | 8/1974 | Mathews | 430/207 |
| 3,833,382 | | 9/1974 | Land | 96/76 C |
| 3,907,563 | | 9/1975 | Land | 96/3 |
| 3,990,895 | | 11/1976 | Land | 96/25 |
| 4,038,077 | | 7/1977 | Land | 96/29 R |
| 4,693,963 | | 9/1987 | McCole | 430/499 |
| 5,453,804 | | 9/1995 | Norris | 354/83 |
| 5,888,693 | * | 3/1999 | Meschter et al. | 430/207 |
| 5,981,137 | * | 11/1999 | Meschter et al. | 430/207 |
| 6,019,525 | * | 2/2000 | Norris et al. | 430/207 |

OTHER PUBLICATIONS

PCT International Search Report, PCT/US 00/26959.

* cited by examiner

*Primary Examiner*—Richard L. Schilling
(74) *Attorney, Agent, or Firm*—Paul M. Corvea

(57) ABSTRACT

The present disclosure relates to several embodiments in which different self-developing film formats are constructed in order to permit easy operator separation of the pod and trap from adjacent integral film units.

14 Claims, 18 Drawing Sheets

PHOTOGRAPHIC FILM ASSEMBLAGES OF THE SELF-DEVELOPING TYPE HAVING REMOVABLE PORTIONS

CROSS-REFERENCE TO RELATED APPLICATIONS

The present application claims the benefit of copending provisional patent application Ser. No. 60/156,984 filed in the U.S. Patent and Trademark Office on Oct. 1, 1999 as well as is a continuation-in-part application of U.S. patent application Ser. No. 08/959,361; now U.S. Pat. No. 5,981,137 issued Nov. 9, 1999 also claims benefit of Provisional Application Ser. No. 06/040,797 filed Mar. 17, 1997.

BACKGROUND OF THE INVENTION

The present invention relates generally to film assemblages of the self-developing type and, more particularly, to improved film assemblages of this type having a plurality of interconnected image forming units that are individually separable relative to each other, and wherein each unit has its associated fluid container and trap removable.

Photographic film assemblages of the so-called self-developing type are generally categorized as so-called "peel-apart" versions, and "integral" versions. In the peel-apart version, provision is made for exposing a photosensitive sheet that is brought together, in overlying relationship, with an image bearing sheet carrying a rupturable container or pod of processing fluid. The sheets pass through a pressure applying assembly comprising a pair of juxtaposed rollers that rupture the container and spread the fluid so as to initiate development of the latent exposed image. Excess fluid that passes between the sheets is collected by a fluid trap. The user peels off the image bearing portion, while the pod and trap areas remain associated with the film assemblage.

Integral film units such as described in commonly-assigned U.S. Pat. Nos. 3,415,645; 3,695,884; 3,833,382 are considered self-contained in that the rupturable container or pod, imaging bearing area, and fluid trap remain together or integral as a unit both prior to and after exposing. Processing is carried out by passing the film unit through processing rollers that rupture the pod and distribute the processing fluid to initiate development. The trap captures excess processing fluid. Therefore, the film unit that emerges from a camera, for instance, is self-contained. U.S. Pat. No. 5,888,683 describes another example of a self-contained film assemblage in the form of an elongated strip that includes a plurality of film units or frames carried thereby; whereby each of the units is separable relative to the others.

For a variety of reasons, however, it is desirable to allow the user of integral film units to retain the image bearing portion free of the spent pod and associated trap. Efforts to achieve such pod and trap removal are known. For instance, commonly-assigned U.S. Pat. No. 2,634,886 discloses a peel-apart type film assemblage using semi-perforations that allow manual severance of the positive print from adjacent areas of the film assemblage including the pod and trap. U.S. Pat. No. 3,804,626 disclose a film assemblage wherein the pod and trap are separated from the film unit; and wherein a processing fluid activated adhesive serves to seal the trailing end of the film unit. U.S. Pat. No. 4,693,963 uses perforations between the positive print and the pod and trap so as to allow for manual separation of the latter so that undesired elements of the film assemblage may be discarded. This patent also teaches sealing along the open edges of the film resulting from detachment. Sealing may be accomplished by a pressure sensitive or processing fluid adhesive on one or more of the mutually facing surfaces of the open edges. Consequently, integrity of the developed film unit is maintained along with prevention of processing fluid leakage.

While efforts along the lines indicated above have been made, there is, nevertheless, a continuing desire to improve upon the ease and reliability of removing from such self-developing film assemblages, the fluid pod and trap portions in a manner that substantially minimizes and/or seals against leakage of processing fluid, either prior to or after film processing.

SUMMARY OF THE INVENTION

According to the present invention there is provided an improved self-developing film assemblage. Included in the film assemblage is a processing fluid supply assembly including a rupturable container or reservoir of processing fluid at a leading end portion of the unit; a self-developing image recording assembly including first and second overlying layers, one of the layers is exposable to form a latent photographic image, and a spacer assembly is connected to and between the first and second layers for providing a processing space therebetween which allows processing fluid to pass therethrough; fluid trap assembly at a trailing end portion of the film unit for collecting excess processing fluid traveling through the processing space; first fluid-tight coupling assembly including a fluid passage for fluidically coupling the reservoir to a leading end of the processing space for allowing processing fluid from a ruptured reservoir to be introduced into the processing space and initiate processing of the latent image; and, second fluid-tight coupling assembly including a fluid passage for fluidically coupling a trailing end of the processing space with the trap assembly for allowing processing fluid to enter into the trap assembly. In the above preferred illustrated embodiment, the end portions of the first and second film unit layers as well as the spacer means include frangible segments that are separable when subjected to manual tearing. Preferably, the frangible segments include tearable zones with accompanying perforations and lands. The perforations and lands are constructed relative to each other to facilitate and guide tearing along a predetermined path or tear line, but which lands have sufficient strength to permit pulling of the perforated film assemblage, under tension, by an operator advancing the film as during processing along a path generally perpendicular to the tear line. The first and second fluid coupling assemblies are attached to the first and second layers to cover and seal the tearable zone.

In an illustrated embodiment, the spacer means are provided with weakened longitudinal edges that facilitate propagating a tear therethrough. In still another embodiment, the perforations in each layer are laterally spaced or registered from the lateral edges thereof to facilitate separation along the tear line, but which prevent premature separation if the film unit is being pulled askew to an intended linear direction. In another preferred embodiment, the first and second fluid-tight coupling assemblies are each sealably secured at interior end portions to opposite ends of the first and second layers of the film unit. The tearable zones are positioned inboard of the respective end portions of the film unit, whereby the zones are sealed by the layers, and any separated segments of the coupling assemblies remaining on the layers are confined within the film unit and thereby presenting a smooth edge.

In still another embodiment, provision is made for a processing fluid activated adhesive on facing surfaces of the fluid-tight couplings on both sides of a tear line along the perforations. The adhesive is arranged so that following tearing along the perforations, such mutually facing surfaces are sealably joinable together. Thus, not only are the layers of the film unit sealable, but the separated ends of the first and second coupling members as well. Hence, processing fluid leakage is substantially minimized or eliminated.

According to another preferred embodiment, provision is made for the first and second fluid-tight coupling assemblies, each including pairs of first and second coupling elements and corresponding first pairs of extension members at respective opposite ends of the film unit. A first coupling element is sealably secured at one end portion to an interior end portion of the first layer of the film unit and the second coupling element is sealably secured at one end portion to an interior end portion of the second layer of the film unit. An opposite end portion of the first coupling element is sealably secured to an end portion of one of the first pair of the extension members, while an opposite end portion of the second coupling is sealably secured to an end portion of the other of the first pair of extension members. The second fluid-tight coupling assembly includes a second pair of first and second coupling elements and a corresponding second pair of extension members. The first coupling element of the second pair is sealably secured at one end portion to a longitudinally opposite interior end portion of one of the first and second layers and the second coupling element of the second pair is sealably secured to a longitudinally opposite interior surface of the other one of the first and second layers. An opposite end portion of the first coupling element of the second pair is sealably secured to an end portion of one of the second pair of extension members, while an opposite end portion of the second coupling element of the second pair is sealably secured to an end portion of the other of the second pair of extension members. The pairs of extension members include the aforenoted construction of perforations and lands as well as the registered spacing of end perforations relative to the film unit.

Furthermore, provisions are also made for methods of manufacturing such film assemblages in a reliable and economical manner.

It is, therefore, an object of the present invention to provide for new and improved film assemblages and methodologies for manufacturing the film assemblages of the self-developing type that are simple and easy to operate and yet result in relatively high yields of reliable and versatile film.

It is also another object of the present invention to provide for new and improved film assemblage of the last noted type in which the processing fluid pod and the associated film trap are removable from the image bearing portion as by tearing.

It is a further object of the present invention to provide for film assemblages of the above type wherein the remaining ends of the image bearing portions are sealable.

The above and other objects and scope of the present invention will become apparent following reading a detailed description thereof when taken in conjunction with the accompanying drawings in which like reference numerals indicate like structure throughout the several views.

DETAILED DESCRIPTION

Reference is made to copending continuation-in-part non-provisional U.S. patent application Ser. No. 08/959,361, entitled; which application is incorporated herein by reference and made a part hereof.

Figure 1:
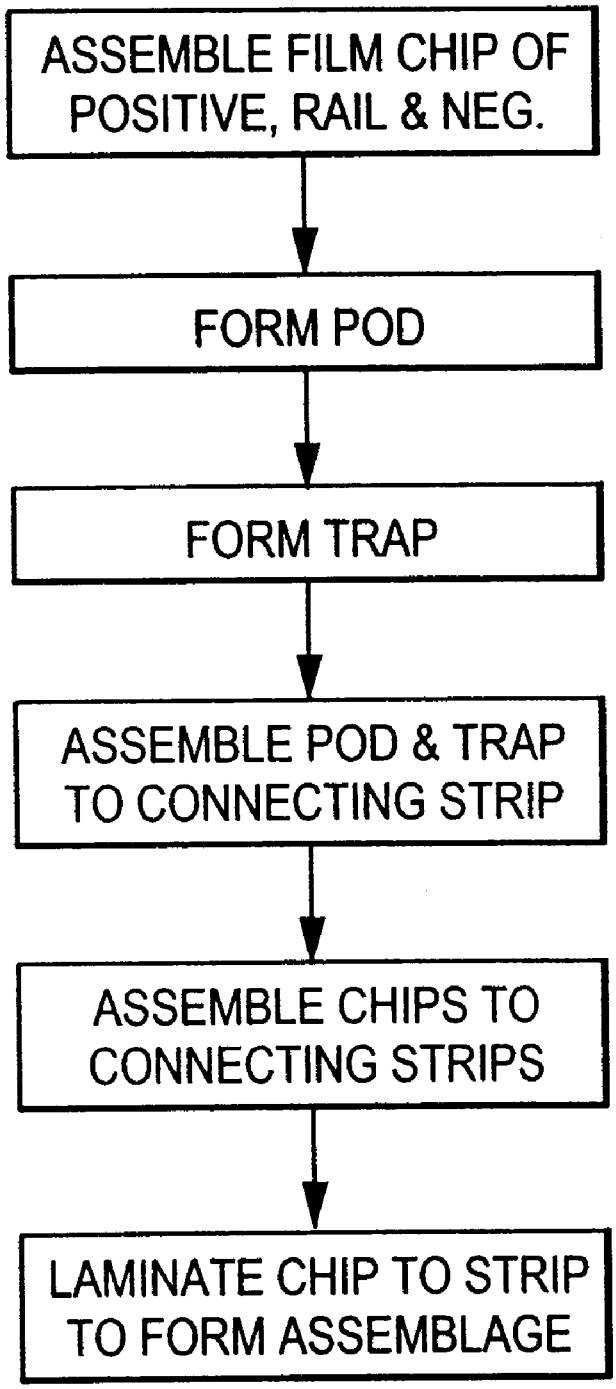
FIG. 1 is a block diagram of one of the preferred methods of manufacturing film in accordance with the present invention.
Figure 2:
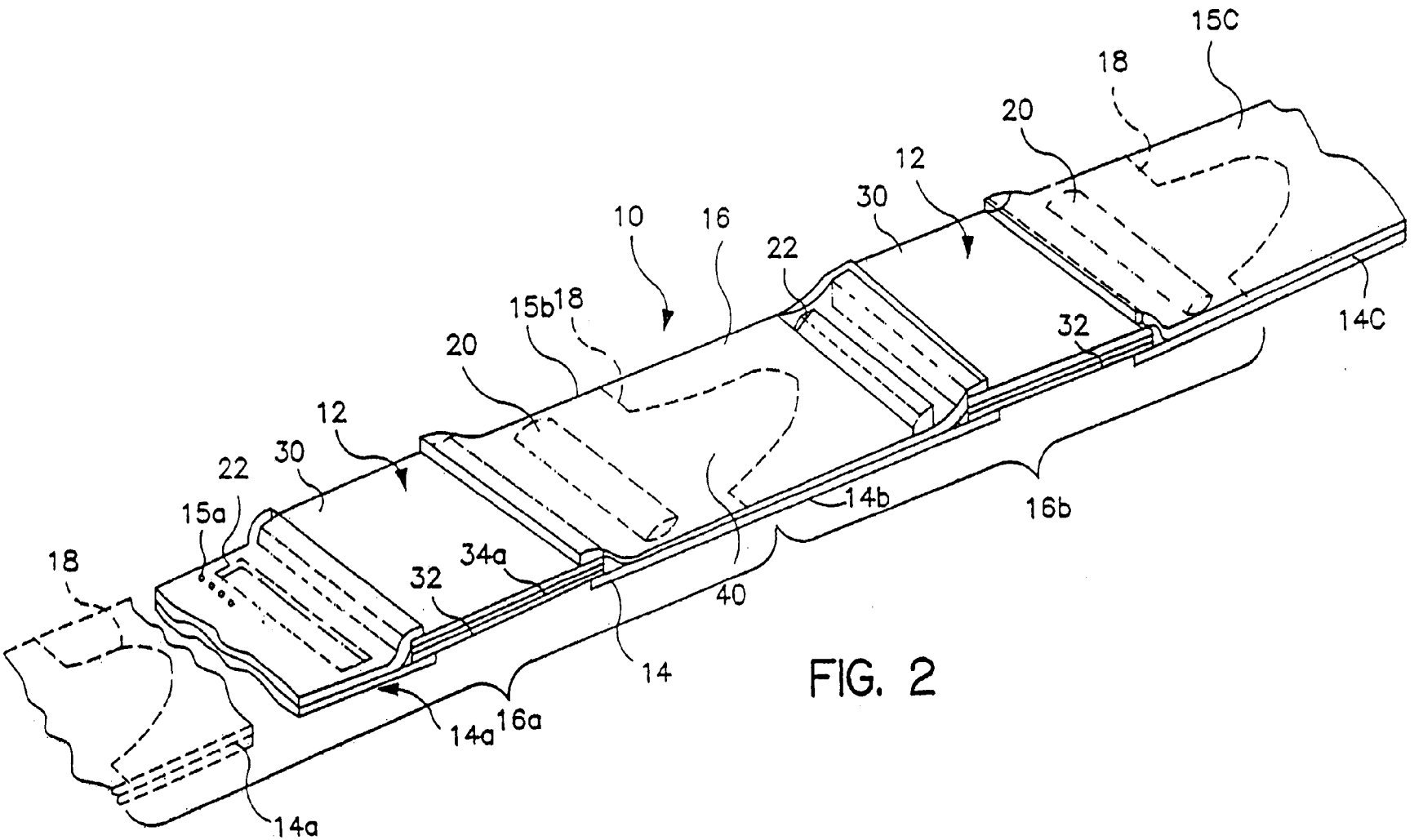
FIG. 2 is a perspective view of the film assemblage, which can be made in accordance with the present invention.

In FIG. 2, a portion of a longitudinally extending photographic film assemblage 10 is illustrated as comprising a plurality of alternately spaced self-developing film units 12 of the integral type; but as will be described, the film units can be made of the self-developing peel-apart type. Coextensive pairs of connecting strips 14*a–c* and covering strips 15*a–c*; respectively, are connected in an alternating linear arrangement to each of the film units 12 so as to form a continuous longitudinal film assemblage. The film assemblage 10 is conveniently subdivided into separable and individual image units or frames 16*a, b* extending lengthwise from a weakened or frangible portion 18 on one pair of the pairs of connecting strips 14*b* to the equivalent portion 18 on the adjacent pair of pairs of ten or twelve frames can be connecting strips 14*a*. For some embodiments, frames can be made. In fact several hundred connected in series. As will be discussed below, the weakened or frangible segments 18, preferably represent structurally weakened sections intended to permit easy separation of successive individual ones of the frames 16*a, b*. FIG. 1 illustrates one sequence in the manufacture of a film assemblage of the present invention.

Essentially, each of the film frames 16*a, b* comprises one of the film units 12, a rupturable container or pod 20 containing processing liquid being located adjacent a leading edge of the film unit 12 and, a trap 22 adjacent the trailing edge of the film unit 12. The trap 22 is adapted to collect excess processing liquid from the ruptured pod which liquid is not consumed during processing of a film unit 12. Both the rupturable pod or container 20 and the trap 22 are secured as by lamination to pairs of connecting and covering strips in a variety of sequence steps by, for example, hot-melt type adhesives; as will be described. A hot-melt laminator will serve to secure the pod and the trap to the connecting and covering sheets as desired. The cooperating pairs of connecting and covering strips can be made of a variety of materials and in this embodiment can be a masking material of the type used in the self-developing art.

Reference is made to the sandwich construction of the individual film units. Each is identical and therefore a description of one will suffice for all. Essentially included in the sandwich construction is a layer or sheet of an image-receiving member 30, and generally coextensive in superposed relationship therewith is a layer or sheet of a photosensitive member 32, as well as laminated therebetween is a pair of the longitudinally extending rails 34*a, b* that are spaced along the marginal edges of the film unit. Although not illustrated, the film unit 12 can also be of the peel-apart type, wherein the respective members 30 and 32 can be separated after processing. In one example of a peel-apart type film, the photosensitive member can be made of the so-called "Excedrin" type, wherein light is transmitted through it to a generally coextensive and superposable cover sheet having a pair of side rails thereto. Such covering sheet is releasably laminated to the photosensitive member. In such an embodiment the covering sheet and rails would take the place of the member 30 and rails 34*a, b*, and can be-removed from the superposed relationship after the image bag developed. Other peel-part configurations are contemplated.

Figure 3A:
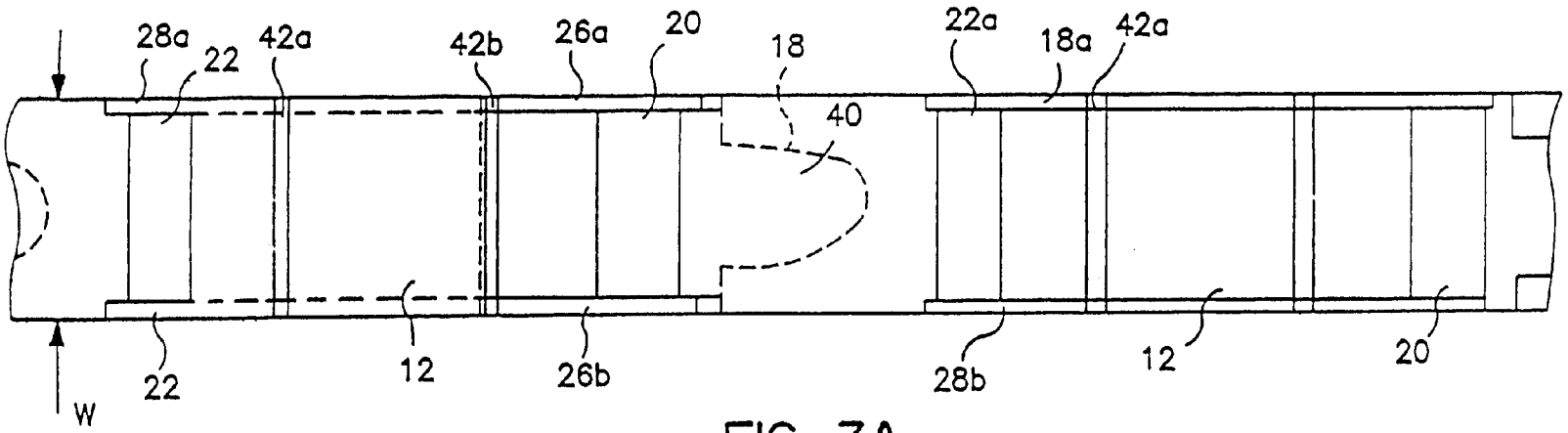
FIG. 3*a* a top plan view of the film assemblage of the invention.
Figure 3B:
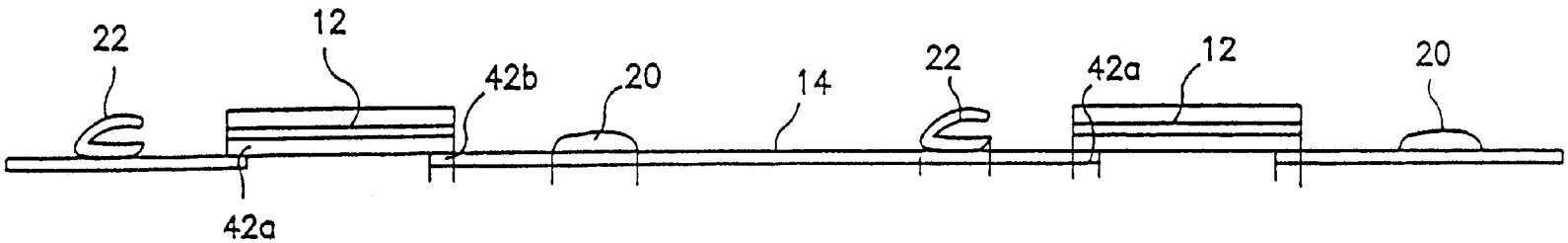
FIG. 3*b* a side view of the film assemblage of FIG. 3*a* during assembly.
Figure 3C:
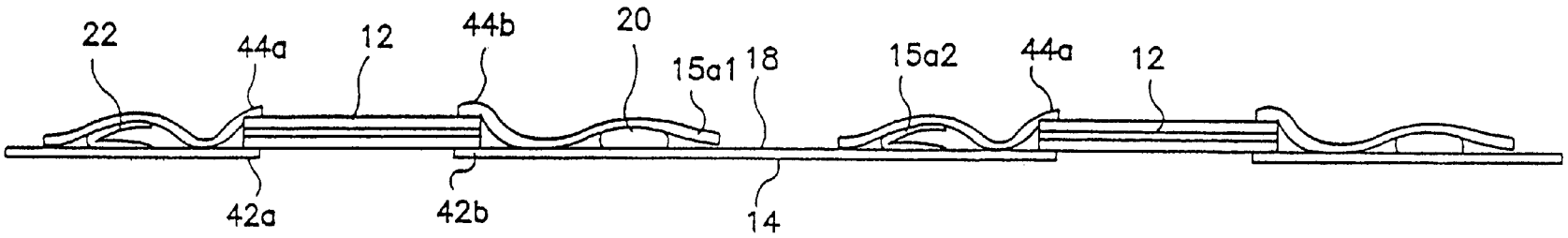
FIG. 3*c* is a side view of an embodiment of the film assemblage of FIG. 3*a* after assembly.
Figure 3D:
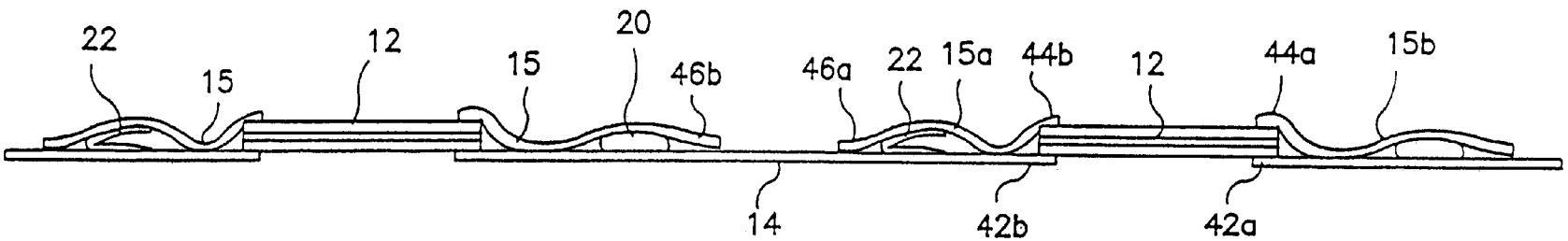
FIG. 3*d* is a side view of another embodiment of the film assemblage of FIG. 3*a* after assembly.
Figure 4:
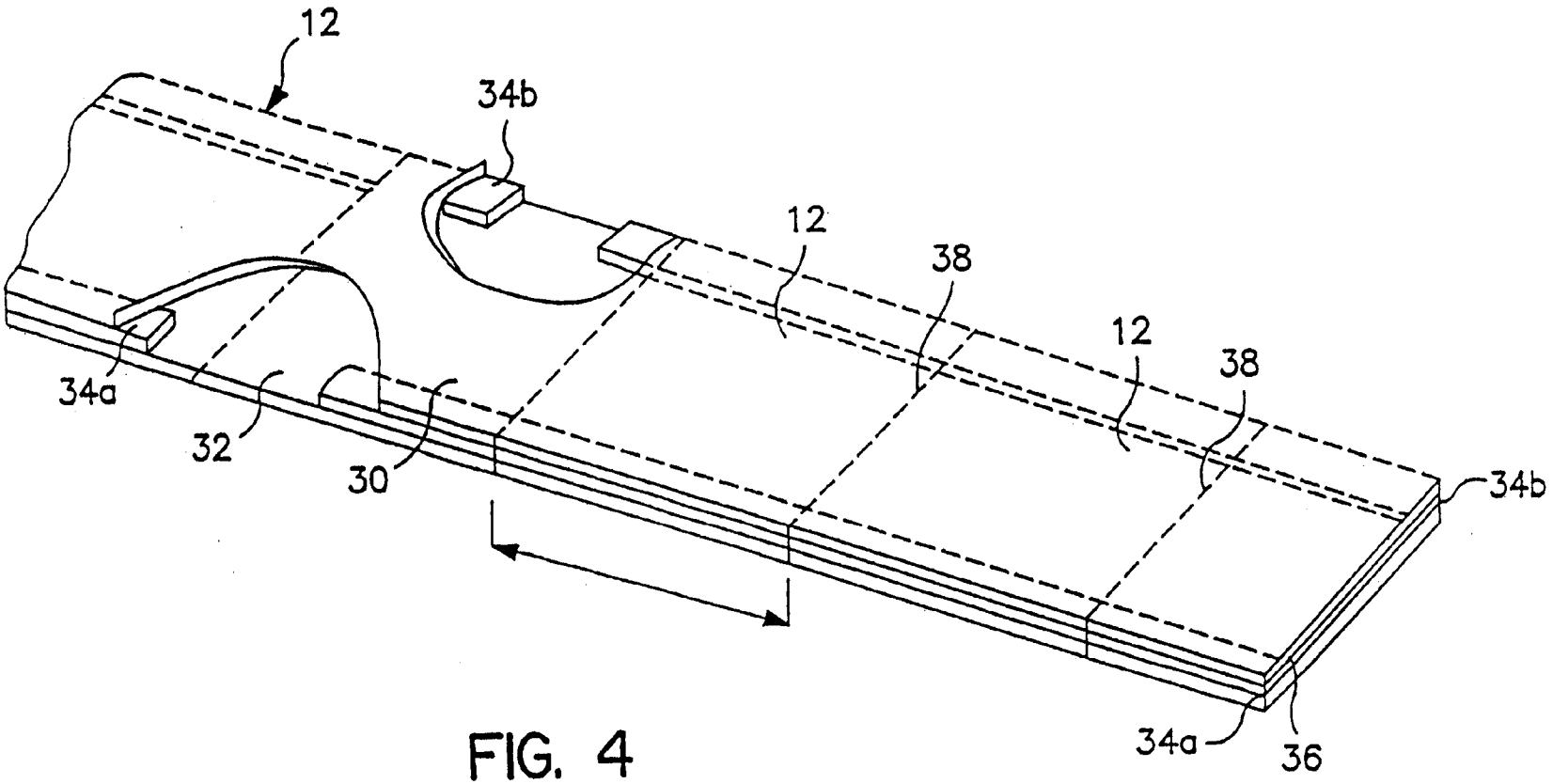
FIG. 4 is a perspective, partially broken out view of the construction of the integral film strip before separation into individual film units used for making the film assemblage of the invention.

Reference is made to FIGS. 2–4. One method of manufacturing the above film assemblage of the integral type includes employing a roll of a laminated film sandwich construction. The rolled sandwich construction when cut generally transversely defines the individual film units 12. The web width of the sandwich can be varied as well as the spacing of the transverse cuts, thereby allowing for the formation of film units of different sizes and aspect ratios. Thus, the illustrated configuration of the film unit is representative of many different variations that are possible by reason of the sandwich construction. To form the rolled laminated sandwich construction; a strip of photosensitive sheet-material 30 and a strip of the image-receiving sheet material 32 are brought into intimate engagement with each other in a coextensive relationship by being fed into a nip of a pair of counterrotating laminating rollers of a rotary feeder (not shown). Fed contemporaneously therewith and along opposite longitudinal edges is a pair of strips of rail material; each coming from an appropriate roll thereof. The rails have the appropriate thickness for the particular film assemblage they are to be used with. These rails, as noted, are sandwiched between the sheets 30 and 32 so as to be positioned along the opposing longitudinal edges thereof. Conditions of heat and pressure are selected for a time period which will ensure the desired laminations. The pressure and time are selected in a desired bonding. For instance, the rollers can both be steel, both rubber covered or one of rubber coating and the other of steel. Thereafter, the appropriately laminated sheets are, preferably wound on a spool for providing a film supply roll. If the film supply 18 after lamination is to be wound onto a spool, then the radius of that spool and the wind-up tension should be chosen equally carefully so as to not cause excessive bending of the composite sandwich; especially those mutually facing portions thereof located between the two rails 34*a*, 34*b*.

It is important to maintain proper tension within the individual sheets and rails and between the sheets and rails, respectively, when the sheets and rails are conveyed from the rolls to the nip. Since the film supply 18 is a composite structure, uneven tension between the image-receiving member 30 and the photosensitive member 32 during lamination can lead to curling of the film supply 18 after lamination. As an example, if the tension in the supply of image-receiving member 30 is higher than the tension of photosensitive member 32 before the nip, then image-receiving member 30 is stretched and will relax, i.e. contract, after lamination. The film supply 18 will therefore curl, with photosensitive member 32 forming a convex surface and image-receiving member 30 forming a concave surface.

As noted above, heat from the lamination process made adversely affect the properties of the photographic sheet and possibly other materials or components, too. The rollers may therefore be made in a way that the roller(s) do(es) not contact the surface of the image-receiving member 30 and/or photosensitive member 32 expect for the lateral marginal edges of the film supply 18 including the rail sections 34*a*, 34*b*. This can be accomplished by a longitudinally extending, radial recess in the roller(s) which may be filled with a material of low thermal conductivity, such as a rubber compound. It is apparent that this concept can be applied to other film structures aside from the embodiment depicted in FIG. 4.

Rail material generally comprises a PET base which has disposed thereon either thin layers of another material, preferably a composite such as paper/fiber, or a preferably liquid coating providing the desired thickness when dry. Subsequently, an adhesive which melts through application of heat is applied to both sides of the rails. Activation temperatures for the adhesive vary depending on several factors including the specific application. As noted to facilitate the sensitometric matching the thickness of the rail sections are adjusted. One manner of achieving this is to have one of the layers with a thickness that is somewhat less than the optimum rail thickness, and the second layer is thinner and can have its thickness varied in accordance with the requirements to obtain correct sensitometry.

One of the advantages of the foregoing sandwich relationship is that the sensitometric relationship of the photosensitive strip and the image receiving strip can be adjusted quite easily by appropriately adjusting the thickness of the rail in a known manner; whereby the thickness of the gap between the image-receiving member and the photosensitive member can be set by the adjusting thickness of the rails. Because of the requirements sensitometrically match the image-receiving member 30 and photosensitive member 32 to each other and to the rail sections 34*a*, 34*b*, the film supply 18, in various embodiments to be discussed hereinafter, are preferably pre-assembled in a factory where their sensitometric properties can be measured and, if necessary, adjusted.

While the foregoing embodiment discloses a preference for rails, the present invention contemplates that no rails need be present between the image-receiving member 30 and photosensitive member 32. The achievement of the noted mechanical gapping desired for spreading would then be achieved by stepped rollers. However with the presence of sandwiched rails, the film unit has no need for use with relatively expensive stepped rollers. In fact, relatively inexpensive generally cylindrical spread rollers may be used instead.

Referring now to FIG. 4, there is shown a segment of a portion of the film unit. Individual film units 12 are subsequently severed, for example cut with a hand cutter at assembly or by a high speed mechanical chopper. Other cutting devices, such as a laser or the like can be used. The two members 30, 32 and the rail sections 34*a*, 34*b* define a laterally opening 36 therebetween for providing a passage of the processing liquid. The image-receiving member 30 and an photosensitive member 32 of each individual film unit 12 are preferably coextensive, and the rail sections are most preferably coextensive with the marginal edges over the entire length of the film unit 12. The film units 12 therefore do not require additional processing after separation. Although the separation cuts are preferably perpendicular to the film surface, the cuts may also be angled in order to provide less volume for any residual processing liquid left in the space proximate to the leading and trailing edges, respectively, of the film unit 12.

Figure 5:
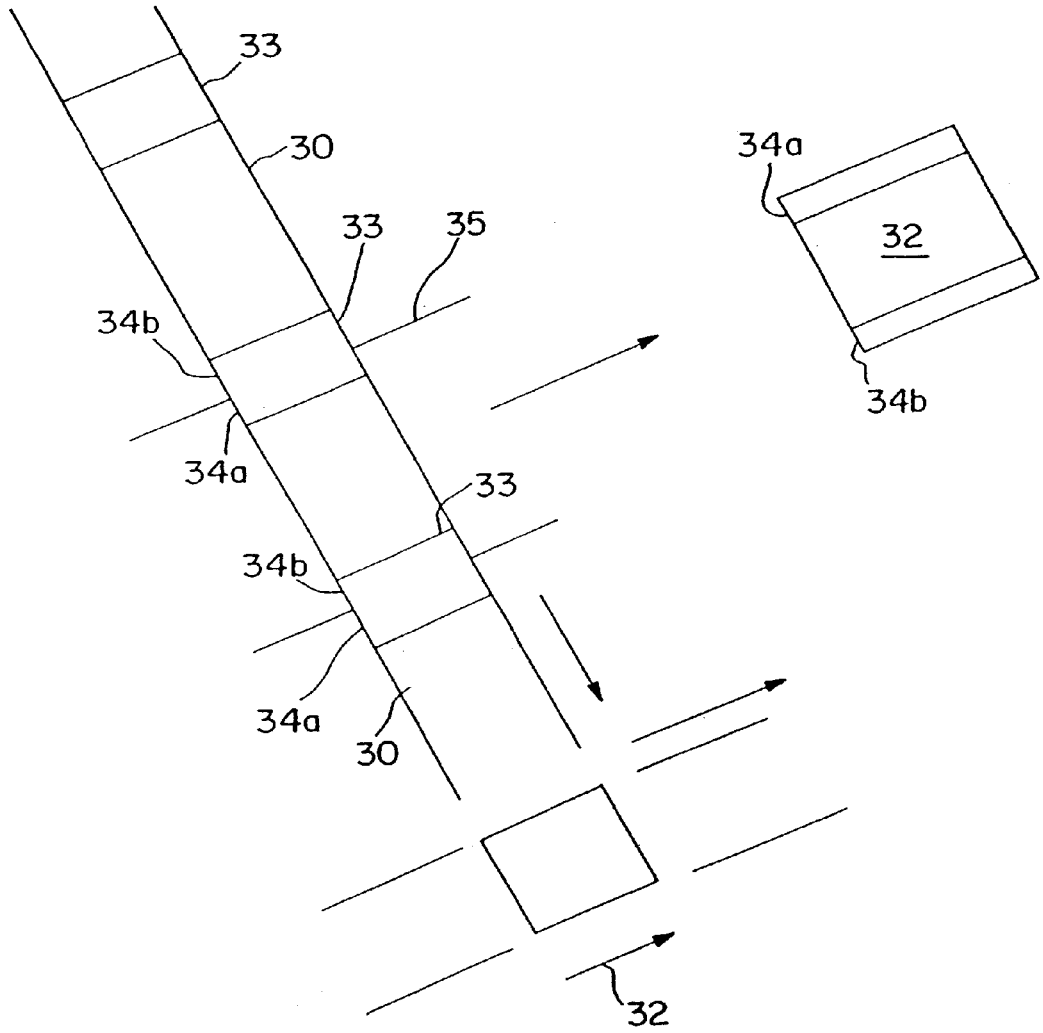
FIG. 5 is schematic version of the one manner of making the film.

Although the film units can be cut from a rolled laminated sandwich construction, other methods of film unit constructions are possible. For instance, reference is made to FIG. 5 for illustrating another one of the preferred methods of construction. As depicted, a strip of photosensitive material 32 advances alone a first path in the direction of the arrows; and, a strip of image-receiving material 30 advances along a second path in the direction of the arrows and could travel at right angles to the negative. In such a method, the image-receiving strip would have secured thereto, as by and at appropriately spaced intervals, known techniques transverse strips of rails 33 made of the appropriate rail material. Each of the rails 33 could have a width which would be at least double the width of a desired film unit side rail. Each of the rails 33 could be cut medially as along a cutting line indicated by reference numeral 35 so as to form segments of two rails 34*a*, 34*b*. The result of the cutting action is the formation of individual sheets of image-receiving members having a pair of appropriately spaced side rails. Thereafter, an appropriately dimensioned photosensitive member 32 can be cut and adhered or secured, as by lamination, to the side rails 34*a*, 34*b*; thereby forming a corresponding film unit 12.

Figure 6:
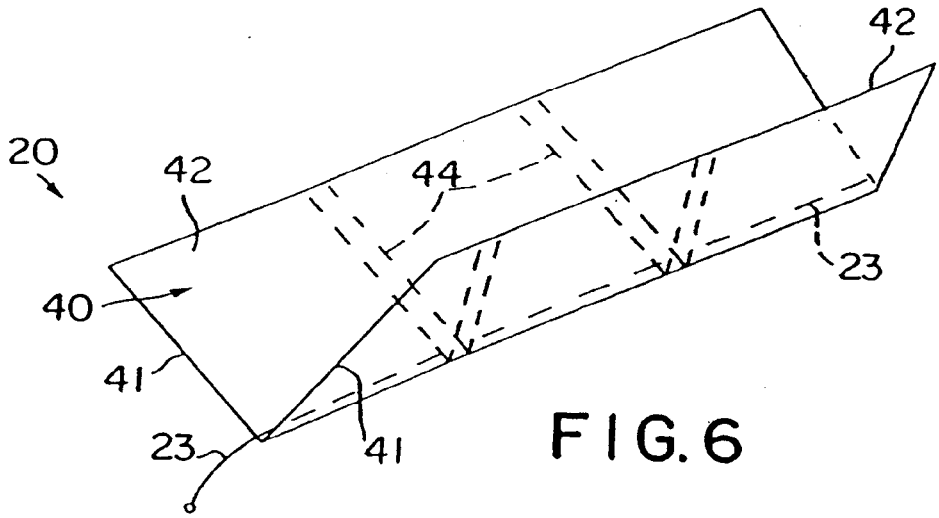
FIGS. 6 & 7 illustrate perspective and end views of one version of forming a pod.
Figure 7:
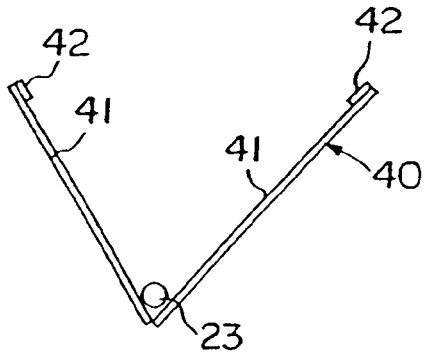
Figure 8:
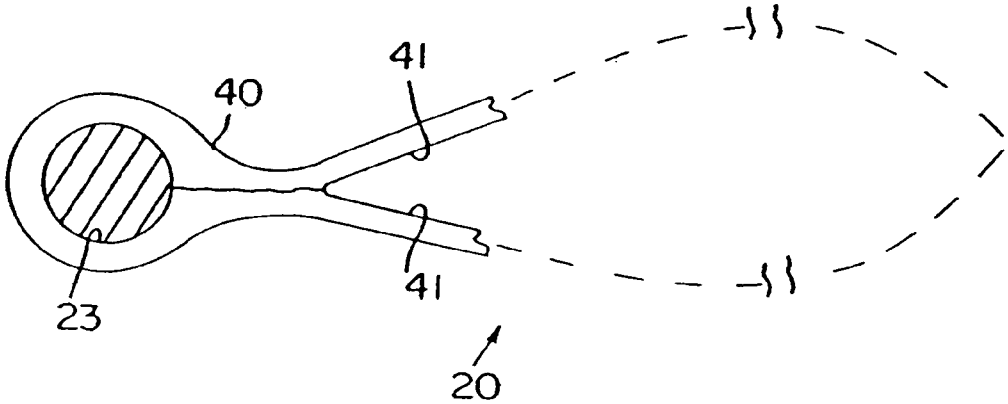
FIG. 8 illustrates one version of a portion of a pod made according to the invention.

After having described some of the methods for manufacturing the film units, reference is now made to FIGS. 2–4 taken together with FIGS. 6–8 for describing the pod 20 and its attachment to film assemblage 10. It will be understood that a wide variety of pod construction can be used in the film assemblage which pods can be made by known pod making methods and hence a detailed description thereof is not needed. In this embodiment, the pod 20 includes a composite sheet structure 40 made of a vinyl layer on the inside surface, an aluminum middle layer and paper outer layer. The pod sheet 40 is medially folded. A puddle of liquid reagent is added to a resultant trough and the top edges 42 of both folds are sealed as well as the end edges thereby achieving a pod of predetermined length. The top edge seal is of a predetermined relatively weaker bond than the other seals so that the pod may rupture therealong and allow distribution of the processing fluid. The pod is cut to proper longitudinal dimensions, i.e. matching the width of the desired image which depends on the film format used, filled with known processing liquid and sealed liquid-tight by lamination along the lateral edges and the rupturing edge opposite to the non-rupturing side of the pod, not necessarily in that order. If desired each pod can be transversely sealed along seal lines 44, whereby there is a vinyl-to-vinyl contact to form pod subcompartments. Formation of such transverse seals is achieved by heat bonding the vinyl inner layer of opposing flaps of the pod together. Later the seals, along these seal lines, can be cut in order to form pods of a smaller predetermined length. However, the present embodiment differs from known pod constructions in that it includes a string 23 positioned along the bottom of the V-shaped trough (see FIG. 6); and as will be described serves as an arresting means for pod advancement. The resistance which is provided in this regard provides a reaction force that is higher than the pulling force on the film unit thereby allowing the frangible sections 18 to fracture and thus separate. However with the string construction, provision is for a resistance which reacts with the rollers in the camera directly and not the walls of the pod, per se. In addition, there is a secondary function in that the string creates an indexing protrusion or stop which serves to properly locate the next successive film unit of the strip at a desired focal cone in the camera. To form this string stop, the string 23 is placed in the bottom of the trough and a portion of the trough immediately above the string is laminated together around the string. In this regard, the vinyl surface on the inside surface of one leg 41 is laminated to the vinyl surface on the inside surface of the other leg 41. Thereafter, the pod is filled and sealed in a known manner as described above. The string therefore provides a bump which initially engages the rollers and therefor lessens the danger of premature pod rupture because it separates unwanted pulling forces acting directly in terms of rupturing the pod.

Although a string is disclosed other materials and geometrically arranged cross-sections are contemplated. Of course, the ends of the string have been removed following insertion in the pod. It is also contemplated that other similar techniques can by used in the formation of such braking protrusions; such as molding or placing a structure on the connecting members or by inserting a material between the connecting and covering strips. The present invention also contemplates having a pod which can be made of a variety of materials which can have a variety of shapes. In addition, the pod can include structure such as metal or be made of materials which serve to resist being cut as by scissors or the like in order to prevent undesired rupture of the pods by cutting. In addition, it is contemplated that instead of protrusions other equivalent braking structure can be used.

Figure 9:
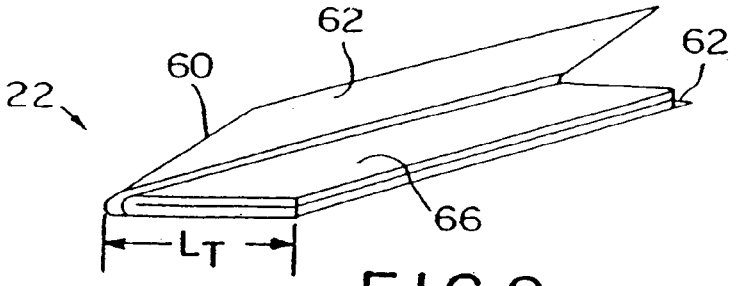
FIG. 9 illustrates one version of a trap.
Figure 10:
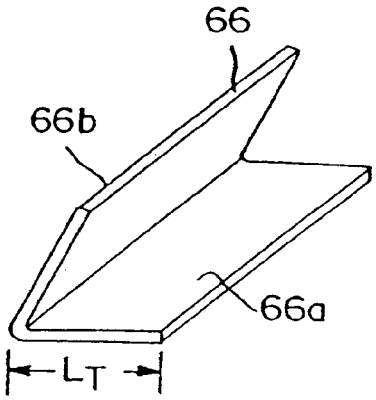
FIG. 10 illustrates another version of a trap.

Reference is made to FIGS. 9 & 10 for illustrating one of the trap embodiments. The various embodiments have in common that the individual traps disposed on the assemblage 10 are separated, for example cut, to the desired length from a preferably continuous tape which is pre-assembled. The trap construction is formed in the manner indicated in the first noted copending application and therefore a detailed description thereof is not needed. It will be appreciated that the trap serves generally to collect the excess processing fluid as well as neutralize it. In addition, the trap serves to spread the processing rollers apart so that the rollers do not continue to force the fluid to burst the trap seal and thereby travel undesirably to the next unit. In this embodiment, there is provided a trap mask 60 having a generally V-shaped configuration which has one of the folds 62 heat sealed at the bottom to one of the connecting sheets and may have the other fold 64 heat sealed to the top covering sheet. A strip 66 of known trap material is heat sealed to the inside surface of the fold 62. This trap construction is fed across the full width of the connecting strips. Another version of a trap is shown in FIG. 10, wherein the strip 66 of trap material is medially folded and both folds 66*a, b* are appropriately secured to the connecting and covering sheets; respectively, as by lamination of the type disclosed.

After having explained the formation of the pods and traps, an explanation of the cooperating pairs of connecting and covering strips will be presented. In this regard, reference is made back to FIGS. 2–3. As noted, the cooperating strips define a liquid-tight fluid passageway between the rupturable container 20 and the leading edge of the film unit 12, as well as between the trailing edge of the film unit 12 and the trap 22. The covering strips are generally coextensive in width with and are disposed on top of the connecting strips. The two strips are secured at their respective ends to the leading and trailing edges, respectively, of the film unit 12 by, for example, appropriate hot-melt adhesives. Furthermore, the pairs of connecting and covering strips are secured and sealed fluid-tight along the side marginal portions 26*a*, 26*b* proximate to the rupturable container 20 and along the side marginal portions 28*a*, 28*b* proximate to the trap 22. In the region between the rupturable container 20 and the trap 22, the pairs of connecting strips and the covering strips are affixed, such as by adhesives or by heat-sealing, to each other in a manner to seal in a liquid-tight manner the rupturable container 20 and trap 22 from the environment, for example by a hot-melt laminator. The pairs of connecting and covering strips are secured in a liquid-tight manner, for example by heat sealing, along respective lateral portions 42*a*, 42*b* to the film units 12 end-to-end in an alternating arrangement. In addition, an essentially "zero gap" remains between the pairs of connecting strips 14 and the covering strip 15. These zone of zero gap is sufficiently dimensioned that it will after processing contain only insignificant amounts of residual processing liquid. The zone is capable of also accumulating any excess reagent which might otherwise "blow back" into the openings 36 of the film unit 12 and cause undesirable image artifacts. The zone also allows easy flexing of the film assemblage. Another advantage is that the relatively stiffer sections of the image unit 12, i.e. the sections where the rupturable container 20 and the trap 22 are secured to the pairs of connecting strips, can be withdrawn from the cooperating camera without bending whereas all other sections of the pairs of strips are easily flexed.

Referring first to FIG. 3*c*, in a first embodiment, there is provided one covering strip 15 for each pairs of connecting and covering strips. The covering strip 15 has substantially the same length and the same width as the pairs of connecting strips 14 and is placed in coextensive registration with and secured to the pairs of connecting strips 14 in the manner described above, e.g. by sealing along marginal edges 26*a*, 26*b*, 28*a*, 28*b* and in the region between the rupturable container 20 and the trap 22. Instead of using a covering strip separate from the connecting strips for providing the fluid passageway, a single connecting strip having an enlarged width can be employed which width is medially foldable lengthwise so that there is only one lamination along the mutually adjoining edges. The fluid passageways may also be made of a single member having all appropriately formed lumen therethrough in order to carry the processing fluid. Of course the film units would have to be inserted into the opposing ends of the lumen.

As previously noted, the film assemblage 10 is preferably provided with structurally weakened sections 18. The sections 18 are weakened by, for example, perforations for facilitating separation of adjacent image units 16*a, b*, etc. The perforations preferably define a tab 40, as is illustrated, which is useful for pulling a leading image unit out of a cooperating camera (not shown), thus facilitating manual processing and allowing an inexpensive camera design. The tab 40 remains after the separation at a preceding image unit separated by pulling. It would, however, be apparent to those skilled in the art that other method suitable for separating successive image units 16, for example notches along the marginal lateral edges or external cutters, could also be employed and the existence of a tab and the location and shape thereof depicted in the figures should be only understood as an exemplary preferred embodiment of the invention.

In another embodiment of the invention, depicted in FIG. 3*d*, the contiguous covering strip 15 of FIG. 3*c* is replaced by a first covering strip 15*a*1 covering and sealing the region extending over the rupturable container 20 and the leading edge of the film unit 12, with a preferably liquid-tight seal along the edge 46*b*, and by a second covering strip 15*b*1 covering and sealing the region extending over the trap 22 and the trailing edge of the film unit 12, with a preferably liquid-tight seal along the edge 46*a*.

During processing of the image units 16*a, b*, etc. in a cooperating camera (not shown), appropriate spreading rollers (also not shown) rupture the rupturable container 20 and spread the processing liquid from the rupturable container 20 to the leading edge of film unit 12, and into the opening 36 and through the film unit 12. Any excess processing liquid exits at the trailing edge of film unit 12 and travels to the trap 22.

It will be appreciated that the preferred methods for attaching and/or securing and/or sealing the various elements and components to each other is by heat or pressure lamination using adhesives responsive to heat and/or pressure, also other methods, such as gluing or welding, may also be contemplated. Such attachment methods are well known in the art. As noted above, the preferred process used for joining the various components of the film assemblage 10 is through an adhesive and the application of pressure and/or heat; this process is referred to as lamination. The most preferred lamination, method is by using a rotary laminator wherein the components to be laminated are brought together in superposed registration between the nips of heated rollers, with pressure applied between the rollers. In the present invention, photosensitive sheet, a plurality of rail sheets in form of strips, and image receiving sheet, in that order, are taken from separate supply rolls and joined by bringing them together into the nip of a pair of driven rolls. Suitable guide and tensioning means may be arranged in a conventional manner to bring the sheets together into registry. The rollers are adapted to provide a suitable pressure and temperature and uniformity of pressure and temperature across the rollers for ensuring proper melting of the hot-melt adhesive disposed on the exposed surfaces of the rail material.

Figure 11:
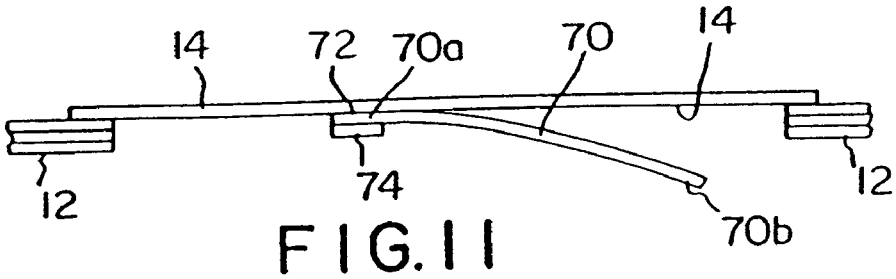
FIGS. 11 and 11*a* illustrate another version of making a trap.
Figure 11A:
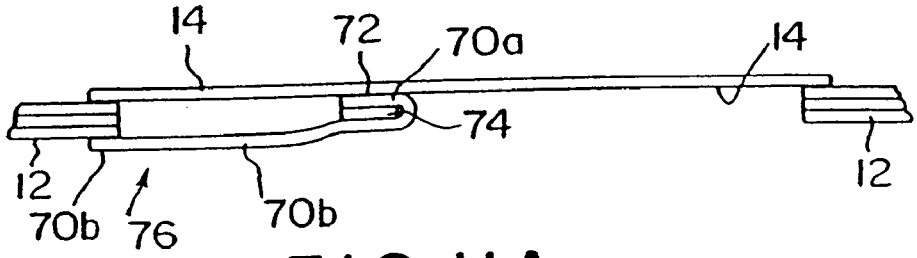

Reference is made to FIGS. 11 and 11*a* for illustrating another trap configuration of the present invention as well as method of making. As illustrated, the connecting strip 14 has a trap mask 70 with its proximal end 70*a* adhesively attached at 72 to an intermediate portion of the connecting strip as at 72. A distal end 70*b* of the rap mask is folded over a strip 74 of trap material and secured to a transverse edge of a film unit 12 thereby forming a trap 76. The lateral ends of the trap mask are then laminated to the side edges of the connecting strip so as to define a self-contained trap.

Figure 11B:
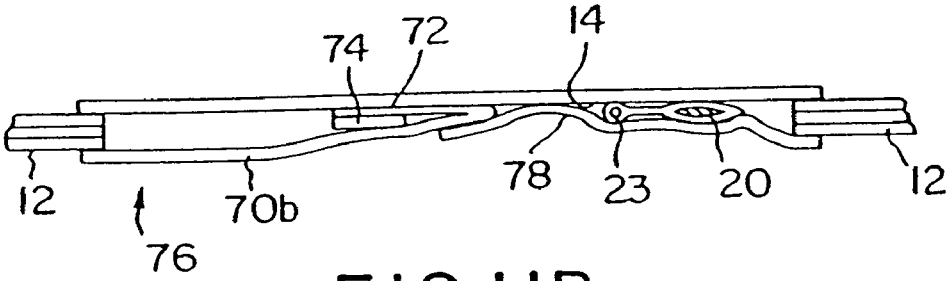
FIG. 11*b* illustrates another version of making the pod and trap.

In the embodiment of FIG. 11*b*, the pod construction of FIGS. 6–8 can for example be placed on the connecting strip 14 adjacent the trap 76 and a covering sheet 78 can be secured to and over the pod at an intermediate portion and the opposing free ends of the sheet 78 can be respectively connected to the trap 76 at one end and at the other end to an adjacent film unit 12. In this embodiment a portion of the trap mask 70 does not have to be sharply folded over the trap mask 70 so as to have some excess. The excess allows bonding thereto with diminished likelihood of the heat from the laminating step causing the trap material 74 being bonded to itself when in the folded condition.

Figure 13C:
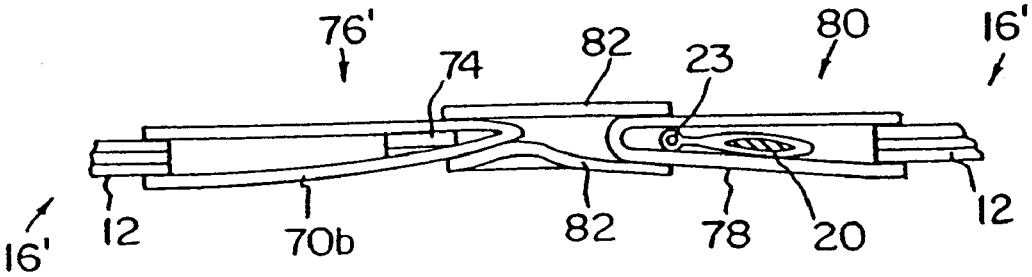
FIG. 13*c* illustrates in more detail the connection between the film units shown in FIG. 13b.
Figure 13A:
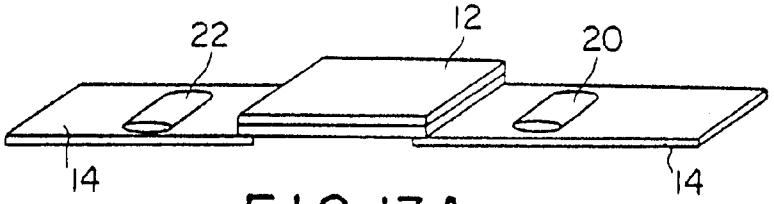
FIG. 13*a* illustrates a step in the manufacture of the film frame of FIG. 12.
Figure 12:
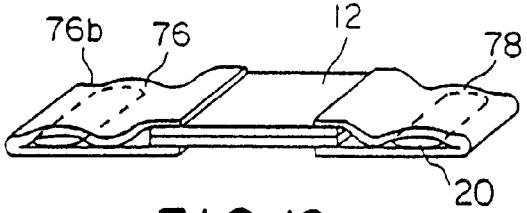
FIG. 12 illustrates a schematic version of a preassembled film unit.
Figure 13B:
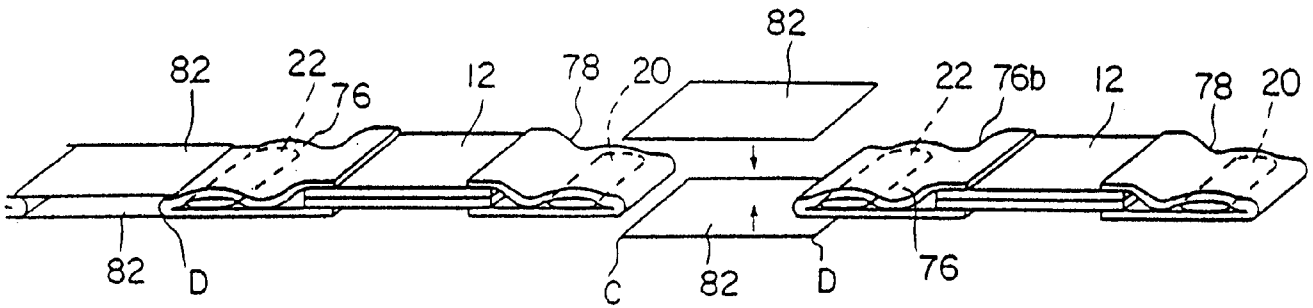
FIG. 13*b* illustrates a step in assembling a plurality of the film frames of FIG. 12.
Figure 15:
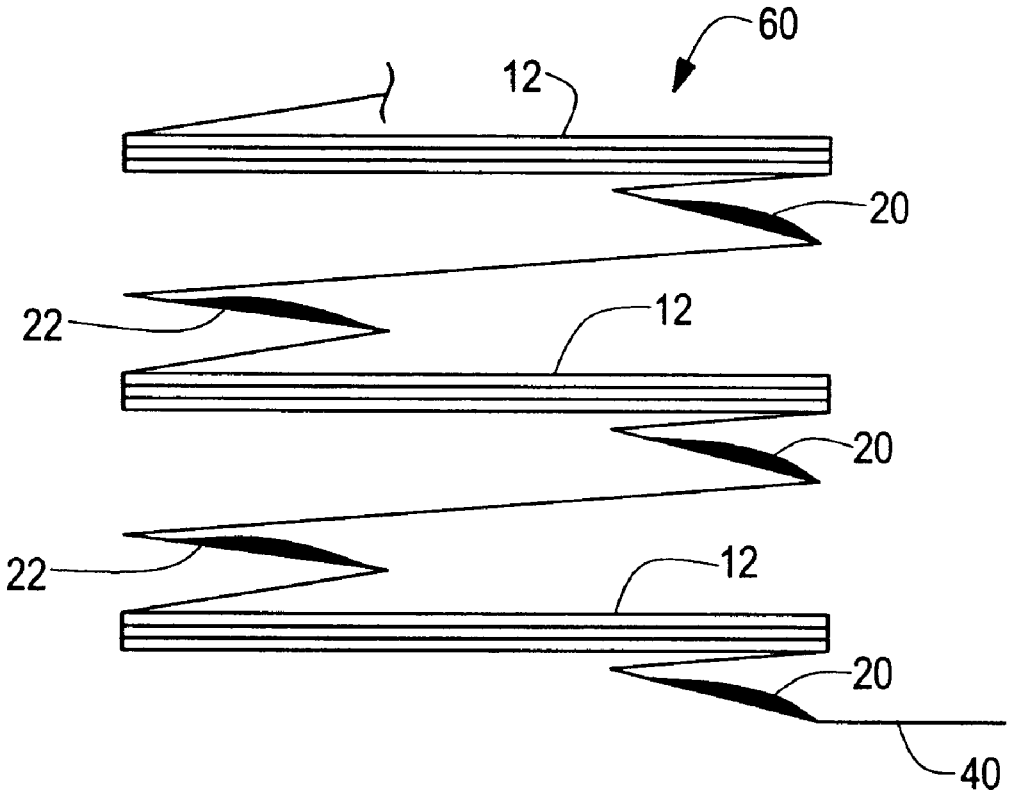
FIG. 15 is a schematic of a film assemblage according to the present invention in folded configuration.

In FIG. 13, there is illustrated another embodiment, wherein both the trap 76' and pod 80 can be foldable connected to the film unit 12, in the same manner as the trap 76 of the previous embodiments. Preliminarily, the pod and trap would be secured to a respective one of the connecting strips 14, as described with the formation of the trap 76 above. As seen in FIG. 13*b*, adjacent film frames 16' could then be connected in series by, for example, a pair of connecting strips 82. The connecting strips 82 can be made of the masking material and are bonded to opposite ends of the film frames ; see FIG. 13*b*. The connecting strips 82 would be appropriately heat sealed to and between the film frames 16'. The connecting strips 82 would preferably have frangible sections (not shown) to facilitate separation of the frames as described above. Although the present embodiment, discloses that the connecting strip s are made of masking material the present invention also envisions that the connecting strips 82 can be made of a variety of materials such as paper preferably with tear characteristics that are relatively easily controlled and therefore reliable. The film frames 16' as thus presassembled for interconnection with the other frames form an assemblage in which it is more likely to utilize most of the assembled frame on the strip. In this construction, there is an advantage in that if one of the film frames is not properly formed, then the film frames connected to the strip need not be considered wasted. Rather only the improperly formed or attached frame needs to be discarded and replaced.

Figure 14A:
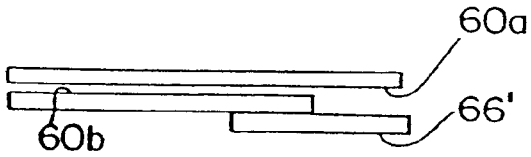
FIGS. 14*a–c* illustrate still another method of making a trap in accordance with the present invention.
Figure 14B:
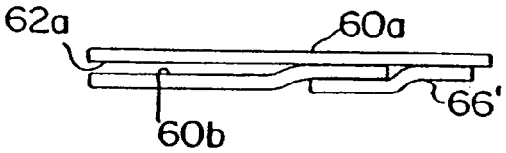
Figure 14C:
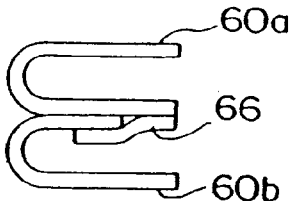

FIGS. 14*a–c* schematically represent various steps in the formation of another trap arrangement of the present invention. In this embodiment, the trap is double folded and strip 66' of trap material is secured as by lamination at the joint of two overlapping tarp masks 60*a*, 60*b*. Thereafter the two masks 60*a*, 60*b* are folded as illustrated in FIG. 14*c*; whereby they may be able to secure top and bottom folds to respective ones of top and bottom connecting and covering sheets.

The foregoing preassembled self-contained frames can then be secured to preassembled pods and traps and connecting means. The use of the preassembled units is particularly advantageous in manufacturing schemes wherein, for example, manual labor is used; especially in a dark room setting. In this connection the preassembled frame units could be shipped as individual units along with preassembled pod, trap and connecting or cover sheets which are made ahead of time. Another method includes having the pod and trap assembled to a connecting strip ahead of time and then in the dark room assemble the film units and then laminate a covering member over those components needing the covering sheet in order to arrive at an assembled film assemblage made in accordance with the present invention.

According to the present invention, the film frames can be formed with preassembled components or continuously. According to the present invention, the structures of the present invention and their methods of construction are highly versatile in that the film assemblage can have different constructions and yet still be able to be used in the same photographic apparatus for which the film assemblage is intended to operate with. This is advantageous over known approaches wherein a single film format is dedicated to the camera, whereby changes in the construction of the film and/or the method of fabricating such a film format would have a high likelihood of rendering such film unusable with the intended photographic device.

Figure 16:
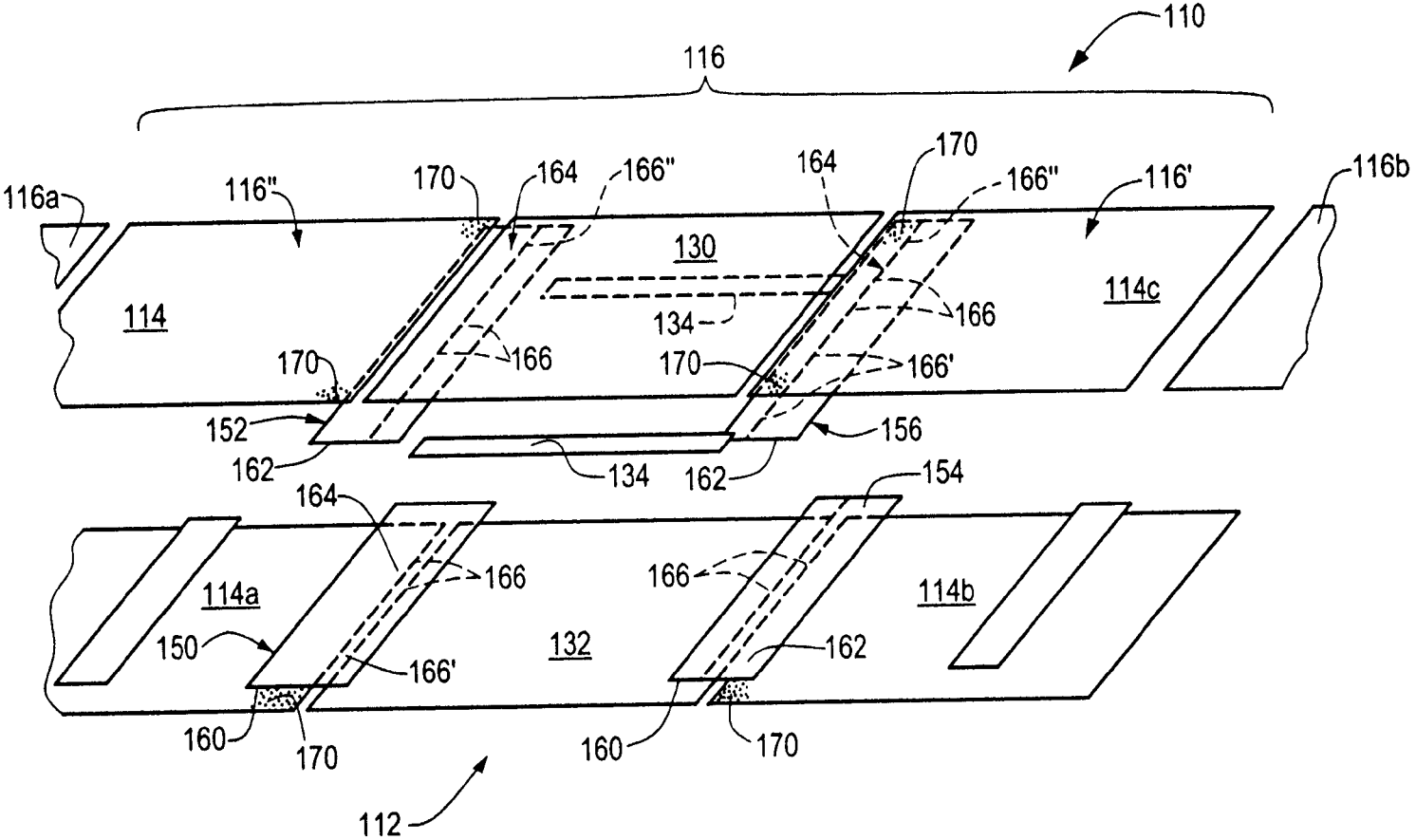
FIG. 16 is a schematic perspective view of another preferred embodiment of the film assemblage according to the present invention.
Figure 17:
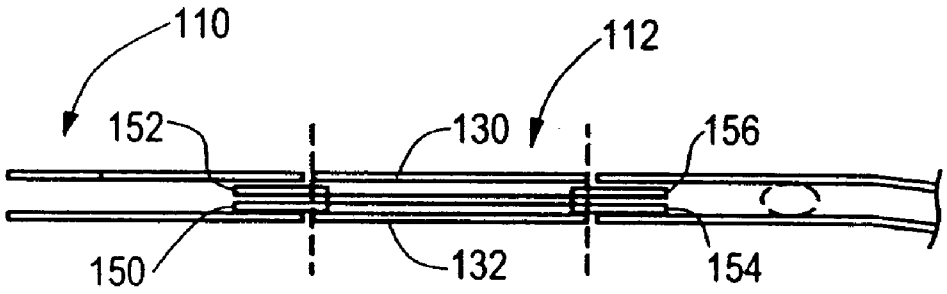
FIG. 17 is a schematic elevational view of the film assemblage of FIG. 16.
Figure 18:
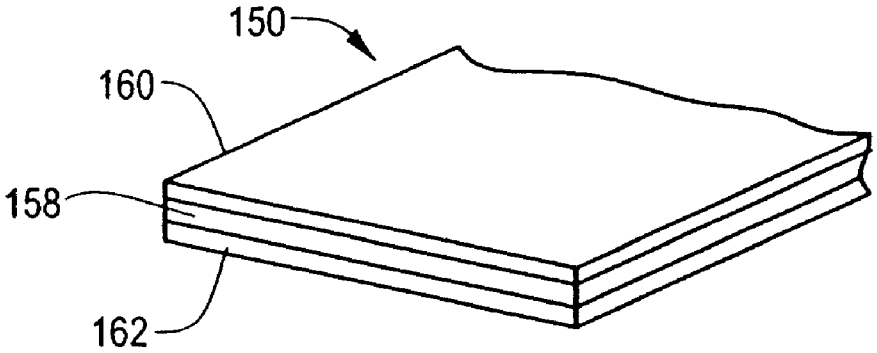
FIG. 18 is an enlarged perspective view of a coupling element of the film assemblage of FIGS. 16 and 17.

Reference is now made to FIGS. 16–18 for illustrating another preferred embodiment of the present invention. In this regard, provision is made for a self-developable film assemblage of the foregoing type, wherein the pod and trap are reliably separated as by being torn by the user and the ends of the remaining image receiving portion are sealable against fluid leakage, in addition to having the torn pod and trap elements sealable.

In this embodiment, the film assemblages 110 is similar in man respects to the construction of the first embodiment. The film assemblage 110 has a plurality of film frames 116, 116*a*, 116*b*. Each of the film frames is frangibly interconnected relative to the other. In addition, each frame is, in turn, frangible whereby each self-developing film unit 112 carried by a frame is separable from the remainder of the frame. Advantageously, a user can separate the film unit and discard both the pod and trap without leakage of residual processing fluid from any of the constituent parts.

Pairs of generally coextensive extension or coupling elements 150, 152; and 154, 156 are provided for facilitating the separating and sealing functions noted above. For instance, the lower coupling element 150 is laminated to respective end portions of the connecting strip 114*a* and the photosensitive sheet 132; while the coupling element 154 is laminated to respective end portions of the connecting strip 114*b* and the photosensitive sheet 132; as illustrated in FIGS. 16 and 17. The upper coupling element 152 is laminated to respective end portions of the connecting strip 114 and the receiving sheet 130; while the coupling element 156 is laminated to respective end portions of the connecting strip 114*c* and the receiving sheet 130; as illustrated in FIGS. 16 and 17.

All the coupling elements are constructed the same and, therefore, a description of one suffices for all. In FIG. 18, the coupling element 150 is illustrated and preferably, comprises a thin, flexible, generally planar wing-like laminate structure including a core 158, a coextensive adhesive layer 160 on one surface of the core and a generally coextensive layer 162 of a processing fluid activated adhesive; such as Gantrez™ on the opposite surface of the core. In fact, a wide variety of materials can be selected for the core, and a wide variety of adhesives for the layers 160 and 162 so long as such materials have the properties to achieve the functions described herein for the core and layers. For instance, the core 158 can be made from polyester; the adhesive layer 160 can be a hot melt adhesive of the type used in manufacturing self-developing film, or cold-weld adhesive; and, the layer 162 can be made from Gantrez™; as well as other suitable processing fluid activated adhesives. In this embodiment, each pair of the coupling laminates at each end of the film units 150–156 has a combined thickness which is generally comparable to the thickness of the rails. Although not shown, the layer 162 can instead be comprised of a plurality of dots that are spaced over the surface of the core. Clearly, other geometrical arrangements of adhesives can be accomplished.

In particular, the hot melt adhesive layers 160 of the coupling elements 150 and 154 are directly laminated, at one end, to an inner end surface portion of the connecting elements 114*a* and 114*b*; respectively, as well as opposite inner longitudinal end surface portions of the photosensitive sheet 132. The hot melt adhesive layers 160 of the coupling elements 152 and 156 are directly laminated, at one end, to an inner end surface portions of the connecting elements 114 and 114*c*; respectively, as well as opposite inner longitudinal end surface portions of the receiving sheet 130. There are several approaches for securing the coupling elements to the film unit layers. In one version, the pairs of coupling elements are adapted to ideally abut against the ends of the laterally spaced apart and generally parallel rails 134 when the film unit 112 is mounted. In such a case the rails are shortened by an amount comparable to accommodate the length that the coupling elements extend inside the edge of the film units. It will be understood that beyond the lateral edges of the coupling elements adjacent the longitudinal edges of the film assemblage, hot melt adhesive 170 is applied for use in effecting a fluid seal. The processing fluid activated adhesive layers 162 are particularly adapted to be activated whenever they have been in direct contact with the processing fluid; as when the film unit is being processed. It will be appreciated that the processing fluid flows over the layers 162 as the fluid is spread following its dispensing from the ruptured pod. In this embodiment, the Gantrez™ coated sections are compressed together by the spread rollers which squeeze the processing fluid across and out to crate a zero-gap between the coupling elements. This action is significant for allowing the Gantrez™ sections of mutually facing sections to adhesively join together for effecting a seal.

Figure 24:
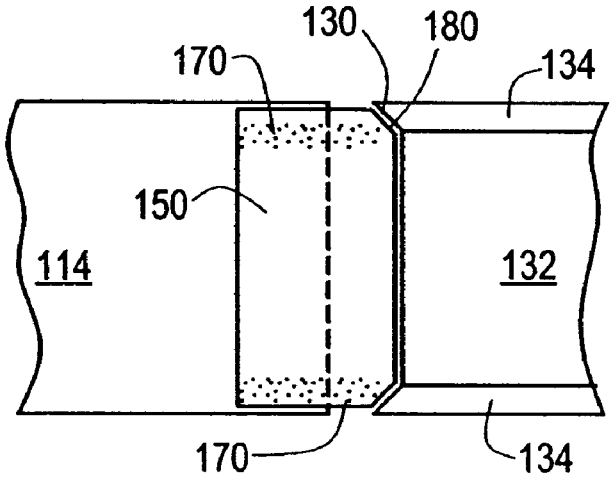
FIGS. 24 and 24*a* illustrate respectively different embodiments of the coupling between coupling elements and the film units.
Figure 24A:
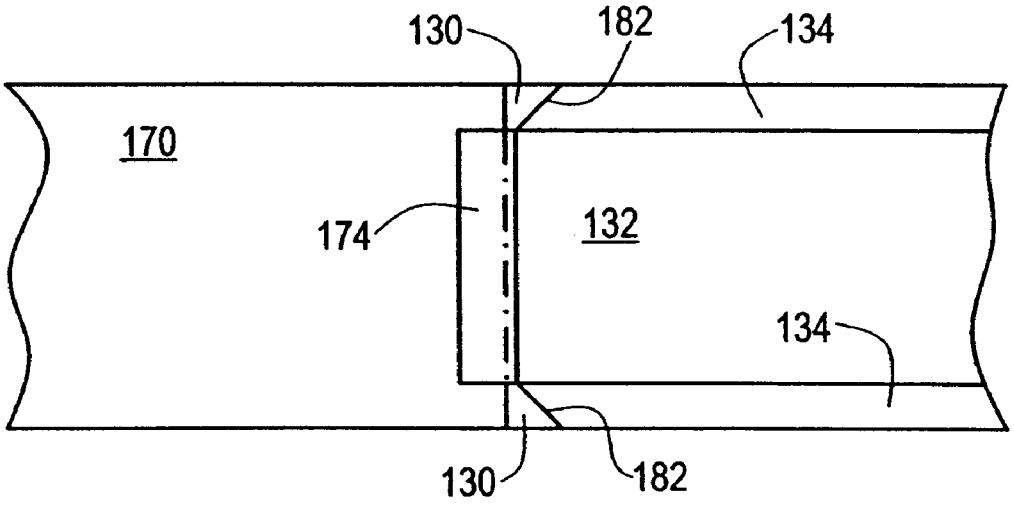

FIG. 24 is a view of a pod end of another embodiment illustrating the complementary tapering at 180 between the rails 134 and leading comers of the coupling element 150 for enhancing the sealing functions provided by the film unit and the coupling elements. FIG. 24*a* illustrates another embodiment of joining the coupling elements 172 having a processing fluid activated adhesive layer 174, such as made of Gantrez™ over one end portion thereof that is to be within the inboard edge of the film unit 112. The processing fluid activated adhesive layer 174 is shorter in width than the coupling elements 172 and leading comers of the coupling elements have extended tapered portions 182 which are complementary to those of the tapered rails.

Although not shown, the present invention envisions that the coupling elements can have a width that fits between the rails; ideally abutting the inside edges of the rails.

Preferably, a linear array 164 of perforations 166 are formed generally across each of the coupling elements; where indicated in FIG. 16. While the preferred embodiments discuss the uses of perforations, it will be understood that other types of frangible constructions (e.g., score lines, micro perforations, ultra sonic scores or perforations) between the connecting members and the film are contemplated to be within the spirit and scope of the present invention. In particular, the perforations 166 are formed in and generally across each core 158 prior to the adhesive layers 160 being added to the latter, thereby assisting in further providing for sealing of the perforations against fluid leakage. Furthermore, the layer 162 can provide for a sealing effect if the core and the layer 160 are perforated. Also, perforation created by melting through the material might be resealed into the slit or perforation by reflow.

The perforations 166 extend, preferably, substantially across the longitudinal axis of the coupling elements thereof and terminate at registered locations short of the lateral edges of such elements and spaced from the lateral edges of the film unit and the coextensive connecting elements or sheets; as is seen in FIG. 16. The connecting elements have predetermined areas of a hot melt adhesive 170 adjacent the lateral edges of the coupling elements so as to provide a fluid seal around the ends of the coupling elements. The linear array of perforations is also located inboard of the ends of the sheets 130, 132.

The perforations 166 are optimized in terms of their size, shape and spacing relative to the resulting strength of the lands therebetween when compared to the tear propagating forces needed to achieve a tearing action through the laminate and connecting elements or strips. In other words, whatever material is selected for the coupling elements 150–156, the lands between each perforation should be individually weaker than the forces required to propagate a tear in an unperforated area of the chosen material. Additionally, the sum of the strengths of all of the lands across the film must be stronger than the force required to pull the film unit through processing rollers of a corresponding camera. It will be understood that individual perforations are not formed at the longitudinal edges of the connecting sheets. This is to avoid increasing the ability of the film assemblage to tear; especially when the latter is pulled at an angle from, for example, a camera to the intended linear pulling path. The end perforations 166' of each array 164 are, preferably, spaced as registered form the edges of the connecting elements 14*a–c* so that tearing can be initiated in the connecting elements. The spacing, size and shape of each perforation can vary. Insofar as the perforated zone is concerned, it will be very strong in tension (during pulling), but weak under tearing load. It will be understood that some materials, such as polyester, must have perforations or tears in order to be manually torn. In the illustrated embodiment, each end perforation in the linear array is spaced ore registered a preselected distance, for example about 0.050 inch, from the edge portion of the film assemblage. This spacing has been determined to provide sufficient strength with the materials used in order to avoid the film prematurely tearing if that latter is pulled at an undesired angle from the camera, yet facilitate separation as by tearing. The respective ends of the sheet and negative as well as the masking elements overlap the perforations 166 and thereby serve to seal the latter. Also contemplated is an additional sealing assembly, such as a strip (not shown) that can cover the perforations.

As noted, the processing fluid layers 162 are activated after the processing fluid from the pod travels through the film unit during processing of the latter. As a result, an operator following tearing of the coupling elements can press the mutually opposed layers 162 together, thereby sealing both ends of the film unit. No reagent is handled by the user since the tear line is inboard and the layer 162 seal the torn ends inboard of the film unit. Accordingly, little or no reagent is present at the ends of the film units.

Furthermore, the processing fluid adhesive layers 162 coated ends of the separated connecting members 114–114*c* can be pressed together, thus sealing the scrap pod and trap end portions and thereby sealing against fluid leakage.

The foregoing construction has been determined to facilitate separation of the pod and trap ends 116', 116"; respectively, from the film unit 112 in an easy and reliable manner that provides a clean edge that minimizes or eliminates the formation of jagged edges of when the ends 116*a* and 116*b* are torn. The perforations 166 are formed inboard, as noted, to provide for a straight exposed edge when the end portions 116' and 116" are torn, so as to control the tearing, whereby torn edges are unlikely to protrude beyond the edges of the film unit 112. The perforations 166 can be formed in a wide variety of constructions, but whatever the size, spacing or shape the lands therebetween should have sufficient strength to allow pulling of the film units through the processing rollers (not shown) in the manner intended without premature separation.

Figure 19:
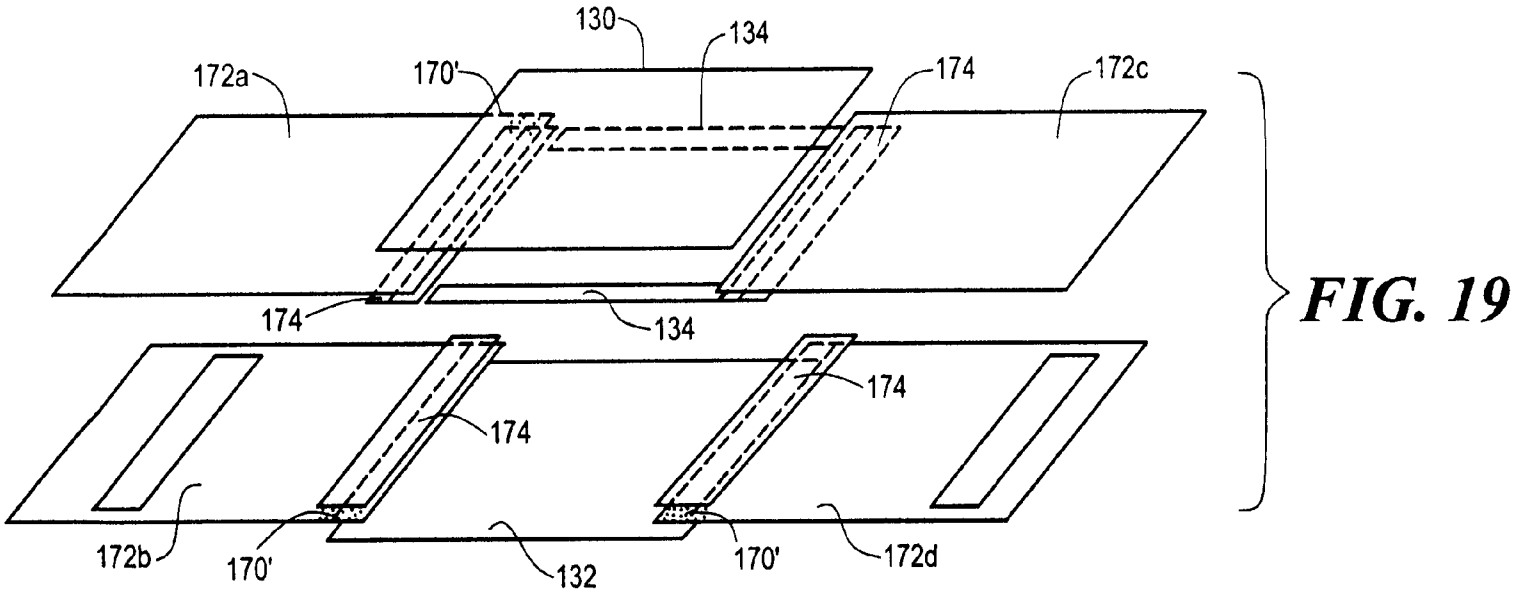
FIG. 19 is a schematic perspective view of yet another preferred embodiment of the a film assemblage according to the present invention.
Figure 20:
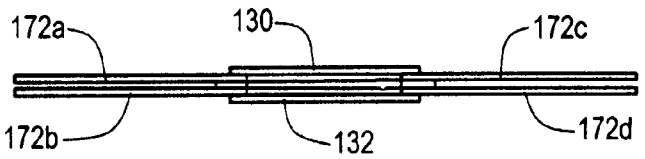
FIG. 20 is a schematic elevational view of the film assemblage of FIG. 19.

Reference is made to another preferred embodiment illustrated in FIGS. 19 and 20. This embodiment is similar to the previous embodiment, but with the changes to be noted hereinafter. One difference is that the coupling and connecting members are combined into a single coupling element 172*a–d* having a processing fluid activated adhesive layer 174, such as made of Gantrez™ over one end portion thereof that is to be within the inboard edge of the film unit 112. Again the edges of the Gantrez™ should be squeezed by the action of the spread rollers.

The processing fluid activated adhesive layer 174 is shorter in width that the coupling elements 172*a–d*, thereby allowing fluid sealing being effected at the ends thereof by the adhesive areas 170' of the mutually facing surfaces of the coupling elements. The perforations 166, as in the last embodiment, are constructed to allow pulling of the film and tearing off the pod and trap. The end edges of the photosensitive and receiving sheets 130, 132; respectively, overlap the perforations 166, thereby further preventing leakage of the processing fluid. The end perforations of each array are registered with respect to the lateral edges of the film unit to prevent premature separation if the film assemblage is being pulled at an angle. The couplings when torn along the perforations that are inboard of the film unit, also have their separated ends sealable by virtue of the processing fluid activated adhesive layer formed at the ends thereof that are pressed together by an operator or automatically by the action of the rollers. This embodiment is less costly and simpler to manufacture than the previous one.

Figure 21:
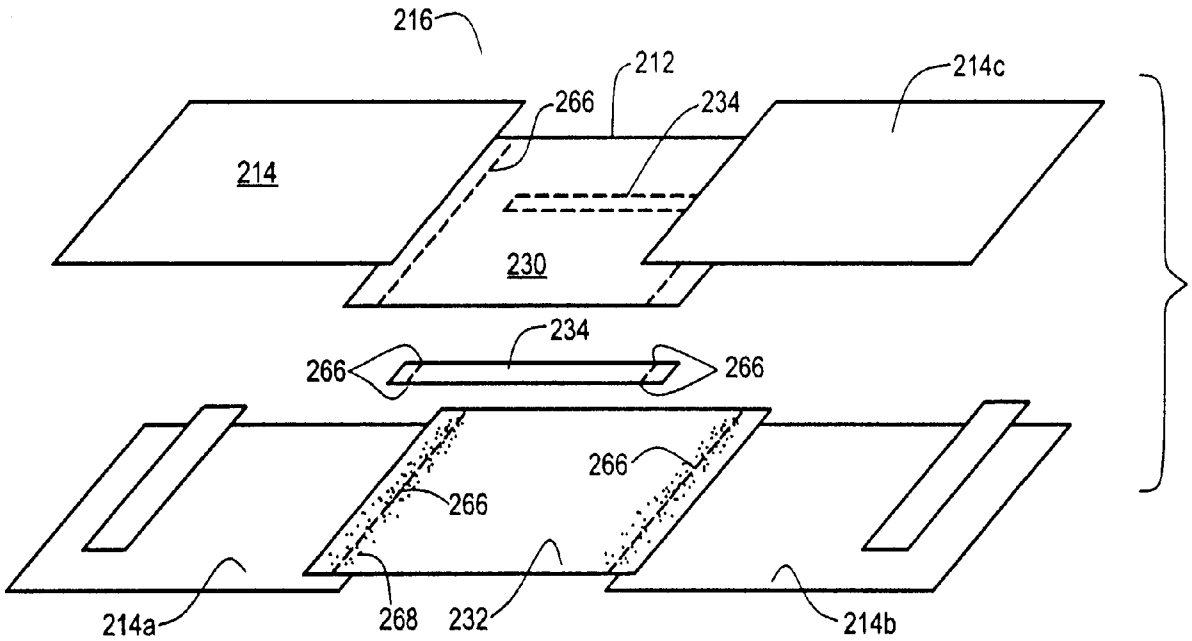
FIG. 21 is a schematic perspective view of yet another preferred embodiment of the film assemblage according to the present invention.
Figure 22:
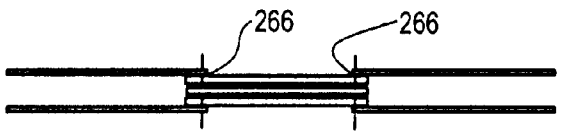
FIG. 22 is a schematic elevational view of the film assemblage of FIG. 21.
Figure 23:
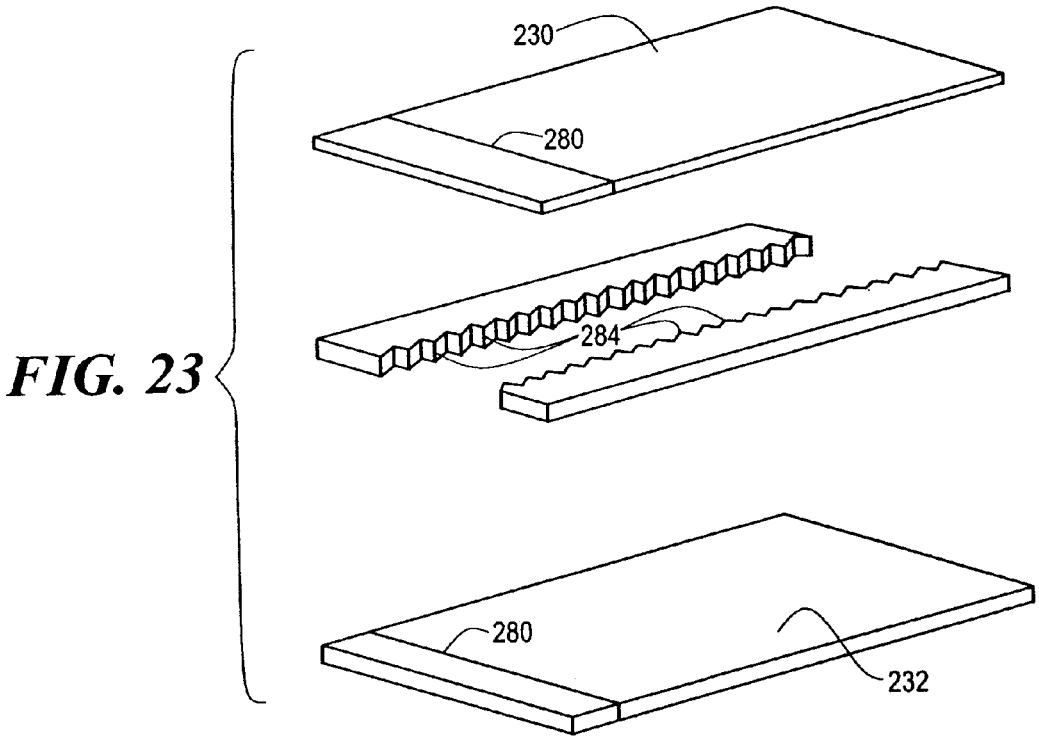
FIG. 23 is a schematic perspective view of yet another preferred embodiment of the film construction of FIG. 21.

Reference is made to yet other preferred embodiments as are illustrated in FIGS. 21–23. Essentially, these embodiments differ from the preceding insofar as the film unit 212 itself is constructed to facilitate separation and sealing of its end portions following processing of the unit.

Towards this end, the longitudinal ends of the negative 232, sheet 230, and rails 234 are perforated at 266 instead of the connecting or coupling sheets. This advantageously eliminates the difficulty of precisely positioning the perforations inboard of the film unit end portions and the corresponding precise placement of the coupling sheets, and associated layers of adhesive. It is important that the perforations 266 are constructed so that they are on the inboard and outboard edges of each rail 234, whereby such placement facilitates tear propagation through the thicker rail without interrupting the tear. Of course, the perforations in the coextensive sheet, rail, and negative are aligned. A variety of techniques can be used for forming the perforations. The lands between individual perforations are as with the other embodiments, promote the pulling in tension of the film unit through the processing rollers as well as facilitate the transverse tearing along the tear line.

The coupling assemblies or sheets 214 and 214*a–c* are laminated to the exterior surfaces of the film unit 212 in order to seal the perforations 266. Ends of the coupling sheets 214, 214*a–c* or assemblies have a layer of hot-melt adhesive (not shown) on the ends thereof that overlap perforations 266 to thereby provide for a fluid seal with respect to the latter. To seal fluidly the end portions of the sheet and negative following processing thereof and separation of the pod and tarp ends, provision is made for processing fluid activated adhesive layers 268 placed at preselected locations on mutually facing surfaces of the sheet and negative. The layers 268 extend on both sides of the perforations 266 and are activated following the processing fluid passing thereover. It will be appreciated that adhesive layers on the separated pod and trap portions will also allow their respective ends to be sealed against fluid leakage. It will be understood that a processing fluid activated adhesive need not be present. This is because the tear line on the film unit presents a new edge, whereat there is less of a likelihood of residual processing fluid being present than the edges of the coupling sheet. The coupling assemblies 214,214*a–c* are sealed along their longitudinal edges and to the film unit in the manner described above.

Referring to FIG. 23, instead of perforations, the sheet 230 and negative 232 can have scored lines 280 thereacross as is illustrated that form the frangible means for facilitating separation of the film unit from the pod and trap areas. The scored lines are aligned with tear propagating notches 282 in the outboard edges of the rail 234. A series of micro notches 284, the drawing depictions thereof are out-of-scale, are formed in the inboard edges of the rail. The micro notches minimizes the criticality aligning rail notches with the score lines. Clearly, the micro notches 284 can be formed on both edges of the rail. The perforation arrangements are necessary for insuring that the tearing action continues virtually uninterruptedly through the entire film unit.

Figure 25:
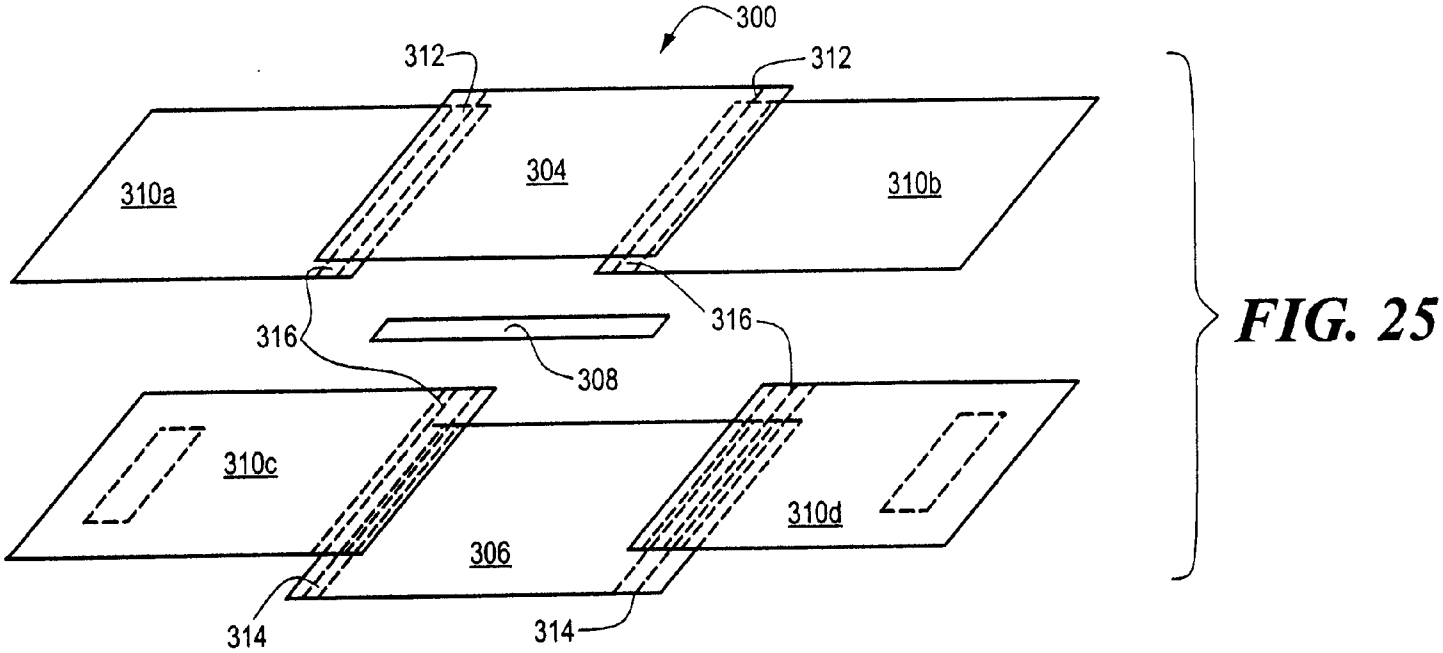
FIG. 25 is an exploded schematic perspective of yet another preferred embodiment; and, FIG. 26 is a schematic elevation view of the embodiment in FIG. 25.
Figure 26:
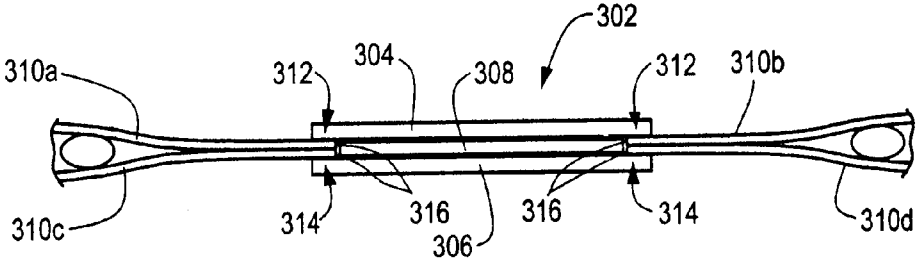

FIGS. 25 and 26 illustrate another preferred embodiment of a film assemblage 300 of the self-developing type wherein a film unit 302 includes a photosensitive layer 304 and an image receiving layer 306 spaced apart by a pair of rails 308 (only one is shown). The connecting sheets 310*a–d* are secured to the inboard surface of the respective layers 304 and 306 as by conventional adhesive layers (not shown). Weakened frangible portions 312, 314 of the layers 304, 306; respectively, are when joined together, preferably vertically aligned with weakened frangible score lines 316 in the inboard end portions of the sheets 310*a–d*. In this embodiment, the mutually opposing surfaces of the connecting sheets are provided with an alkali-based adhesive (not shown). In this embodiment, the combined thickness of the sheets inboard of the unit 302 is approximately equal to the thickness of the rail.

While there have been described what at present are considered to be the preferred embodiments of the present invention, it will be readily apparent to those skilled in the art that various changes may be made therein without departing from the intention.

What is claimed is:

1. An improved self-developing film unit comprising: processing fluid supply means including a rupturable reservoir of processing fluid at a leading end portion of the unit; image recording means of the self-developing type including first and second overlying layers one of which is exposable to form a latent photographic image, and spacer means connected to and between said first and second layers for providing a processing space therebetween for allowing processing fluid to pass therethrough; fluid trap means at a trailing end portion of the film unit for collecting excess processing fluid traveling through said processing space; first fluid-tight coupling means including a fluid passage for fluidically coupling said reservoir to a leading end of said processing space for allowing processing fluid from a ruptured reservoir to be introduced into said processing space and initiate processing of the latent image; and, second fluid-tight coupling means including a fluid passage for fluidically coupling a trailing end of said processing space with said trap means for allowing processing fluid to enter into said trap means; said first coupling means having one end portion sealably secured to an exterior surface of said reservoir and a second end portion sealably secured to an interior surface of a leading end portion of said image recording means; and, said second coupling means having an end portion sealably secured to and within the trailing end portion of said image recording means and an opposite end portion sealably secured to an exterior surface of said trap means; said image recording means comprises a photosensitive layer, an image receiving layer in overlying and coextensive relationship to said photosensitive layer; said image receiving layer and said photosensitive layer being of the integral diffusion transfer type; and, said spacer means comprises a pair of spaced apart and generally parallel elongated rails coextensive with and adjacent opposed marginal edges of said layers; wherein each of said first and second fluid-tight coupling means is made of a pair of resiliently flexible sheets which are sealably joined together to define the respective fluid passages and which are made of a foldable and rollable material to thereby facilitate folding and unfolding thereof as well as permit rolling action of the fold during folding of the film unit; wherein the combined thickness of each of said sheets is substantially equal to a thickness of one of said rails.

2. The film unit of claim 1 wherein portions of said sheets of said first and second coupling means which are inboard of respective ones of said leading and trailing end portions have a fluid activated adhesive layer on at least one surface of mutually opposing surfaces; said adhesive layers being configured and sized to be on both sides of a frangible portion extending across a substantial width of the inboard portions of said sheets.

3. The film unit of claim 2 wherein said frangible portions are formed by scored lines.

4. The film unit of claim 3 wherein said photosensitive layer and said image receiving layer at the leading and trailing ends thereof have frangible portions which are generally aligned with the frangible portions of said sheets.

5. The film unit of claim 4 wherein the frangible portions of said sheets and said layers are generally vertically aligned.

6. An improved self-developing film unit comprising: a rupturable reservoir of processing fluid at a leading end portion of the unit; image recording means of the self-developing type including first and second overlying layers one of which is exposable to form a latent photographic image, and spacer means connected to and between said first and second layers for providing a processing space therebetween for allowing processing fluid to pass therethrough, wherein said spacer means includes spacer rails; a fluid trap assembly at a trailing end portion of the film unit for collecting excess processing fluid traveling through said processing space; first fluid-tight coupling means including a fluid passage for fluidically coupling said reservoir to a leading end of said processing space for allowing processing fluid from a ruptured reservoir to be introduced into said processing space and initiate processing of the latent image; and, second fluid-tight coupling means including a fluid passage for fluidically coupling a trailing end of said processing space with said trap assembly for allowing processing fluid to enter into said trap assembly; the end portions of the first and second film unit layers and said spacer means include frangible segments that are separable when subject to manual tearing; said frangible segments include tearable zones with accompanying perforations and lands; said perforations and lands are constructed relative to each other to facilitate and guide tearing along a predetermined path or tear line; but which lands have sufficient strength to permit pulling of the perforated film assemblage under tension by; said first and second fluid coupling assemblies are attached to the first and second layers to cover and seal the tearable zone; wherein the first and second fluid-tight coupling assemblies are each sealably secured at interior end portions to opposite ends of the first and second layers; the tearable zones are positioned inboard of the respective end portions, whereby the zones are sealed by the layers, and any separated segments of the coupling assemblies remaining on the layers are confined within the film unit.

7. The film unit of claim 6 wherein the spacer rails are provided with weakened longitudinal edges that facilitate propagating a tear therethrough.

8. The film unit of claim 6 wherein the perforations in each layer are laterally spaced or registered from the lateral edges to facilitate separation along the tear lines, but which prevent premature separation if the film unit is being pulled askew to a linear path.

9. The film unit of claim 6 further including a processing fluid activated adhesive on at least one of two mutually facing surfaces of the fluid couplings on both sides of the tear line; whereby the adhesive is arranged so that following the tearing along the perforations, such mutually facing surfaces are sealably joinable together; whereby not only are the layers of the film sealable, but the separated ends of the first and second coupling members, thereby minimizing or eliminating fluid leakage.

10. An improved self-developing film unit comprising: a rupturable reservoir of processing fluid at a leading end portion of the unit; image recording means of the self-developing type including first and second overlying layers one of which is exposable to form a latent photographic image, and spacer means connected to and between said first and second layers for providing a processing space therebetween for allowing processing fluid to pass therethrough, wherein said spacer means includes spacer rails; a fluid trap assembly at a trailing end portion of the film unit for collecting excess processing fluid traveling through said processing space; first fluid-tight coupling means including a fluid passage for fluidically coupling said reservoir to a leading end of said processing space for allowing processing fluid from a ruptured reservoir to be introduced into said processing space and initiate processing of the latent image; and, second fluid-tight coupling means including a fluid passage for fluidically coupling a trailing end of said processing space with said trap assembly for allowing processing fluid to enter into said trap assembly; the first and second fluid-tight coupling assemblies, each including pairs of first and second coupling elements and corresponding first pairs of extension members at respective opposite ends of the film unit; a first coupling element is sealably secured at one end portion to an interior end portion of the first layer of the film unit and the second coupling element is sealable secured at one end portion to an interior end portion of the second layer of the film unit; an opposite end portion of the first coupling element is sealably secured to an end portion of one of the first pair of the extension members, while an opposite end portion of the second coupling is sealably secured to an end portion of the other of the first pair of extension members; said second fluid-tight coupling assembly includes a second pair of first and second coupling elements and a corresponding second pair of extension members, the first element of the second pair is sealably secured at one end portion to a longitudinally opposite interior end portion of one of the first and second layers and the second coupling element of the second pair is sealably secured to a longitudinally opposite interior surface of the other one of said first and second layers; an opposite end portion of the first coupling element of the second pair of extension members, while an opposite end portion of the second coupling element of the second pair is sealably secured to an end portion of the other of the second pair of extension members; the pairs of extension members include the end portions of the first and second film unit layers and said spacer means include frangible segments that are separable when subject to manual tearing; said frangible segments include tearable zones with accompanying perforations and lands; said perforations and lands are constructed relative to each other to facilitate and guide tearing along a predetermined path or tear line; but which lands have sufficient strength to permit pulling of the perforated film assemblage under tension by; said first and second fluid coupling assemblies are attached to the first and second layers to cover and seal the tearable zone.

11. The film unit of claim 10 wherein the spacer rails are provided with weakened longitudinal edges that facilitate propagating a tear therethrough.

12. The film unit of claim 10 wherein the perforations in each layer are laterally spaced or registered from the lateral edges to facilitate separation along the tear lines, but which prevent premature separation if the film unit is being pulled askew to a linear path.

13. The film unit of claim 10 wherein the first and second fluid-tight coupling assemblies are each sealably secured at interior end portions to opposite ends of the first and second layers; the tearable zones are positioned inboard of the respective end portions, whereby the zones are sealed by the layers, and any separated segments of the coupling assemblies remaining on the layers are confined within the film unit, thereby presenting a generally smooth edge.

14. The film unit of claim 10 further including a processing fluid activated adhesive on at least one of two mutually facing surfaces of the fluid couplings on both sides of the tear line; whereby the adhesive is arranged so that following the tearing along the perforations, such mutually facing surfaces are sealably joinable together; whereby not only are the layers of the film sealable, but the separated ends of the first and second coupling members, thereby minimizing or eliminating fluid leakage.

* * * * *